US010093446B2

(12) United States Patent
Brundage

(10) Patent No.: US 10,093,446 B2
(45) Date of Patent: Oct. 9, 2018

(54) BLANKS AND METHODS FOR FORMING CONTAINERS HAVING STACKING PLATFORMS

(71) Applicant: WestRock Shared Services, LLC, Norcross, GA (US)

(72) Inventor: David Joe Brundage, Salinas, CA (US)

(73) Assignee: WestRock Shared Services, LLC, Atlanta, GA (US)

( * ) Notice: Subject to any disclaimer, the term of this patent is extended or adjusted under 35 U.S.C. 154(b) by 0 days.

(21) Appl. No.: 15/432,406

(22) Filed: Feb. 14, 2017

(65) Prior Publication Data

US 2017/0152072 A1 Jun. 1, 2017

Related U.S. Application Data

(63) Continuation of application No. 14/543,601, filed on Nov. 17, 2014, now Pat. No. 9,566,756.

(51) Int. Cl.

| | |
|---|---|
| ***B65D 5/00*** | (2006.01) |
| ***B65D 5/42*** | (2006.01) |
| ***B65D 5/54*** | (2006.01) |
| ***B65D 5/10*** | (2006.01) |
| ***B31B 3/36*** | (2006.01) |
| ***B31B 3/52*** | (2006.01) |
| ***B31B 3/60*** | (2006.01) |

(52) U.S. Cl.

CPC ..... *B65D 5/003* (2013.01); *B31B 3/36* (2013.01); *B31B 3/52* (2013.01); *B31B 3/60* (2013.01); *B65D 5/106* (2013.01); *B65D 5/4266* (2013.01); *B65D 5/4279* (2013.01); *B65D 5/4295* (2013.01); *B65D 5/54* (2013.01); *B31B 2201/2637* (2013.01); *B31B 2201/2675* (2013.01); *B31B 2201/6017* (2013.01); *B31B 2203/066* (2013.01)

(58) Field of Classification Search

CPC ..... B65D 5/003; B31B 3/26
USPC ..... 229/5.5, 109, 920, 930, 931
See application file for complete search history.

(56) References Cited

U.S. PATENT DOCUMENTS

| | | | | |
|---|---|---|---|---|
| 4,709,852 | A * | 12/1987 | Stoll | B65D 5/003 206/509 |
| 5,139,196 | A * | 8/1992 | Fry | B65D 5/10 229/109 |
| 5,573,175 | A * | 11/1996 | Straub | B65D 5/10 220/DIG. 6 |
| 7,434,721 | B2 * | 10/2008 | Feltz | B65D 5/029 229/109 |

(Continued)

*Primary Examiner* — Christopher Demeree
(74) *Attorney, Agent, or Firm* — WestRock IP Legal

(57) ABSTRACT

A blank of sheet material for forming a container includes a plurality of side panels and a glue panel coupled together in series along a plurality of generally parallel fold lines. At least one of the generally parallel fold lines has an increased stiffness. The blank also includes a plurality of bottom panels. At least one of the bottom panels includes at least one bottom corner portion that extends adjacent to and beneath a free bottom edge of a corresponding one of the corner panels and the glue panel. The blank further includes a plurality of top panels. At least one of the top panels includes at least one top corner portion that extends adjacent to and above a free top edge of a corresponding one of the corner panels and the glue panel.

11 Claims, 13 Drawing Sheets

(56) References Cited

U.S. PATENT DOCUMENTS

| | | | | |
|---|---|---|---|---|
| 8,011,565 | B2 * | 9/2011 | Quaintance | B65D 5/28<br>229/120.26 |
| 9,022,913 | B2 * | 5/2015 | Graham | B31B 1/28<br>493/462 |
| 2011/0204127 | A1 * | 8/2011 | Brundage | B65D 5/001<br>229/5.5 |

* cited by examiner

BLANKS AND METHODS FOR FORMING CONTAINERS HAVING STACKING PLATFORMS

REFERENCE TO RELATED APPLICATIONS

This application is a continuation of U.S. application Ser. No. 14/543,601 filed Nov. 17, 2014, now U.S. Pat. No. 9,566,756 issued on Feb. 14, 2017, the contents of which is incorporated herein by reference in its entirety.

BACKGROUND

The embodiments described herein relate generally to a blank for forming a container and, more particularly, to a blank for forming a self-locking container having top and bottom stacking platforms.

At least some known containers that are used to transport and/or store products may be stacked one on the other when the products are being transported or stored. The side walls of the containers on the lower layers of the stack are configured to support a weight of the containers on the upper layers of the stack. However, if the weight on a lower container causes the side walls of the lower container to bulge slightly, a bottom wall of an upper container can settle into, or "nest" within, a cavity defined by the sidewalls of the lower container. Products within the lower container may then be required to support the weight of the upper layers. As such, the products within the containers may be damaged during transport and/or storage.

At least some such containers are at least partially formed using a folder-gluer machine. More specifically, at least some of those containers are four-sided and are formed on a folder-gluer machine configured to form four-sided containers.

BRIEF DESCRIPTION

In one aspect, a blank of sheet material for forming a container is provided. The blank includes a plurality of side panels and a glue panel coupled together in series along a plurality of generally parallel fold lines. The plurality of side panels includes a plurality of corner panels. At least one of the plurality of generally parallel fold lines has an increased stiffness as compared to the others of the plurality of generally parallel fold lines. The blank also includes a plurality of bottom panels. Each bottom panel extends from a bottom edge of a corresponding one of the plurality of side panels. At least one of the plurality of bottom panels includes at least one bottom corner portion that extends adjacent to and beneath a free bottom edge of a corresponding one of the corner panels and the glue panel. The blank further includes a plurality of top panels. Each top panel extends from a top edge of a corresponding one of the plurality of side panels. At least one of the plurality of top panels includes at least one top corner portion that extends adjacent to and above a free top edge of a corresponding one of the corner panels and the glue panel.

In another aspect, a container formed from a blank of sheet material is provided. The blank includes a plurality of side panels and a glue panel coupled together in series along a plurality of generally parallel fold lines. At least one of the plurality of generally parallel fold lines has an increased stiffness as compared to the others of the plurality of generally parallel fold lines. The container includes a plurality of side walls that includes a plurality of corner walls. The plurality of side walls cooperate to define a boundary of the container. The container also includes a bottom wall that includes at least one bottom corner platform portion. Each at least one bottom corner platform portion is disposed proximate a bottom edge of a respective one of the corner walls, and each at least one bottom corner platform portion extends outside the boundary. The container further includes a top wall that includes at least one top corner platform portion. Each at least one top corner platform portion is disposed proximate a top edge of a respective one of the corner walls, and each at least one top corner platform portion extends outside the boundary.

In yet another aspect, a method for forming a container from a blank of sheet material is provided. The blank includes a plurality of side panels and a glue panel coupled together in series along a plurality of generally parallel fold lines. At least one of the plurality of generally parallel fold lines has an increased stiffness as compared to the others of the plurality of generally parallel fold lines. The method includes rotating the plurality of side panels about the plurality of generally parallel fold lines to form a plurality of side walls of the container. The plurality of side walls includes a plurality of corner walls, and the plurality of side walls cooperate to define a boundary of the container. The method also includes rotating a plurality of bottom panels of the blank to be substantially perpendicular to the plurality of side walls to form a bottom wall of the container, such that the bottom wall includes at least one bottom corner platform portion. Each at least one bottom corner platform portion is disposed proximate a bottom edge of a respective one of the corner walls, and each at least one bottom corner platform portion extends outside the boundary. The method further includes rotating a plurality of top panels of the blank to be substantially perpendicular to the plurality of side walls to form a top wall of the container, such that the top wall includes at least one top corner platform portion. Each at least one top corner platform portion is disposed proximate a top edge of a respective one of the corner walls, and each at least one top corner platform portion extends outside the boundary.

DETAILED DESCRIPTION

Figure 1:
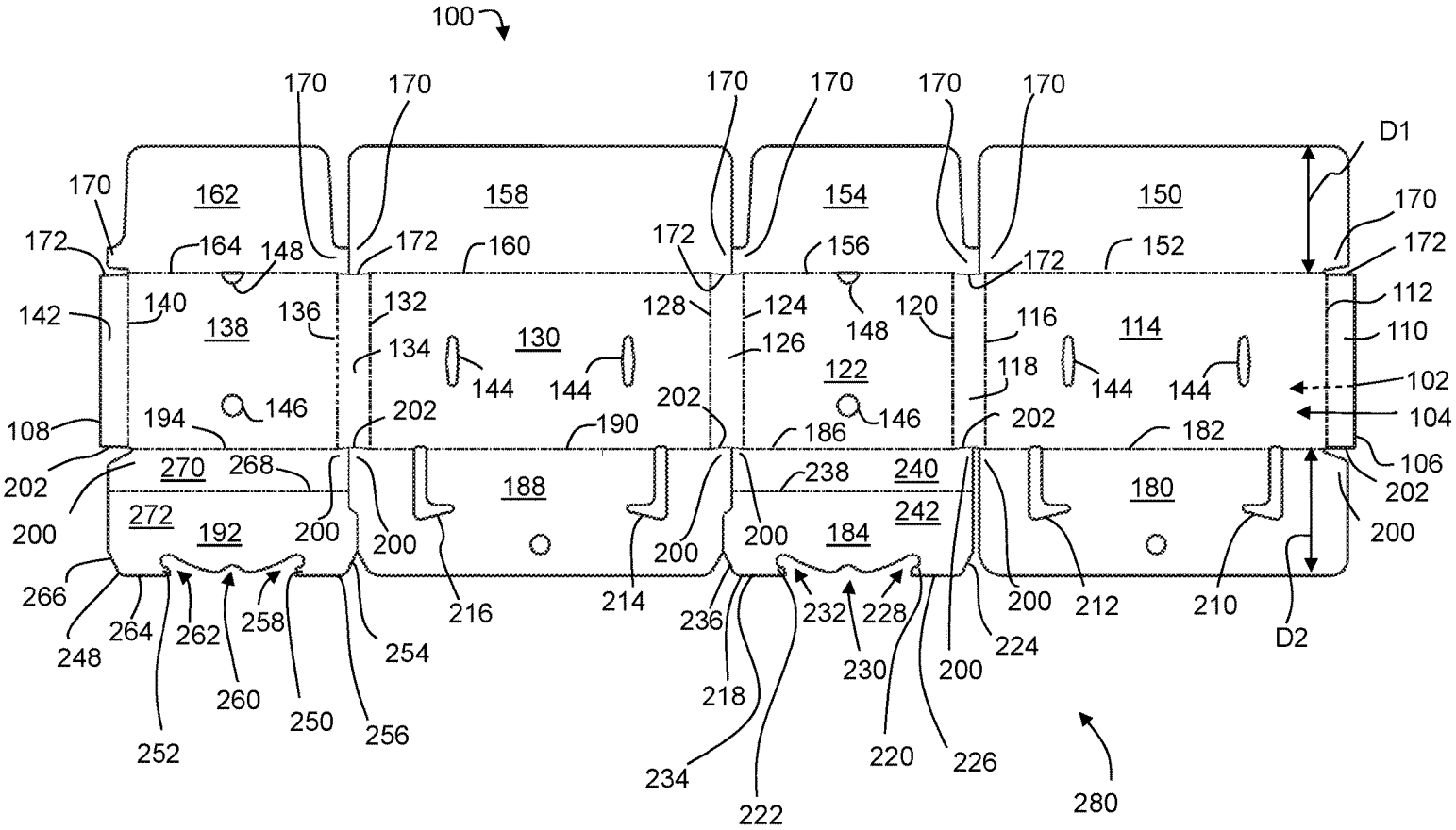
FIG. 1 is a top plan view of a first embodiment of a blank of sheet material.

The embodiments described herein provide an eight-sided container that includes top and bottom stacking platforms. The top stacking platform is defined by corner platform portions of a top wall, and the bottom stacking platform is defined by corner platform portions of a bottom wall, that each extend beyond a boundary defined by the side walls. The container is constructed from a blank of sheet material using a machine and/or by hand. The blank includes a plurality of side panels coupled together in series by preformed, generally parallel fold lines. For example, the blank can be formed into a knocked-down-flat ("KDF") configuration using a folder-gluer machine configured for forming four-sided containers in KDF configuration, and the final construction of the container can be performed by hand and/or by another machine. In certain embodiments, at least one of the parallel fold lines is formed with an increased stiffness as compared to the others of the plurality of fold lines to facilitate forming the KDF container on a four-sided folder-gluer machine. The increased stiffness inhibits unintended rotation of the blank about the at least one fold line while the blank moves through the four-sided folder-gluer machine.

In certain embodiments, the container includes an insert configured to reinforce at least one side wall. The insert may be either attached to the at least one side wall, such as by stapling or gluing, or simply positioned against the at least one side wall. The at least one side wall reinforced with the insert enables the containers described herein to be stronger than similar containers without reinforced side walls, especially when subjected to vertical compression. For example, the inserts can be inserted in the field as containers are positioned on the lower levels of a stack of containers, enhancing an ability of the lower layer containers to support the upper layers of the stack.

In one embodiment, the container is fabricated from a paperboard material. The container, however, may be fabricated using any suitable material, and therefore is not limited to a specific type of material. In alternative embodiments, the container is fabricated using cardboard, plastic, fiberboard, paperboard, foamboard, corrugated paper, and/or any suitable material known to those skilled in the art and guided by the teachings herein provided.

In an example embodiment, the container and/or a blank includes at least one marking thereon including, without limitation, indicia that communicates the product, a manufacturer of the product and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product and/or a seller of the product. Furthermore, the container may have any suitable size, shape and/or configuration, i.e., any suitable number of sides having any suitable size, shape and/or configuration as described and/or illustrated herein. In one embodiment, the container includes a shape that provides functionality, such as a shape that facilitates packaging a food item, a shape that facilitates transporting the container, and/or a shape that facilitates stacking and/or arrangement of a plurality of containers.

Further, different embodiments described herein can vary in size and/or dimensions although similar labels are used for each embodiment. For example, although a depth is labeled similarly throughout the description, each embodiment can have varying depths.

Figure 2:
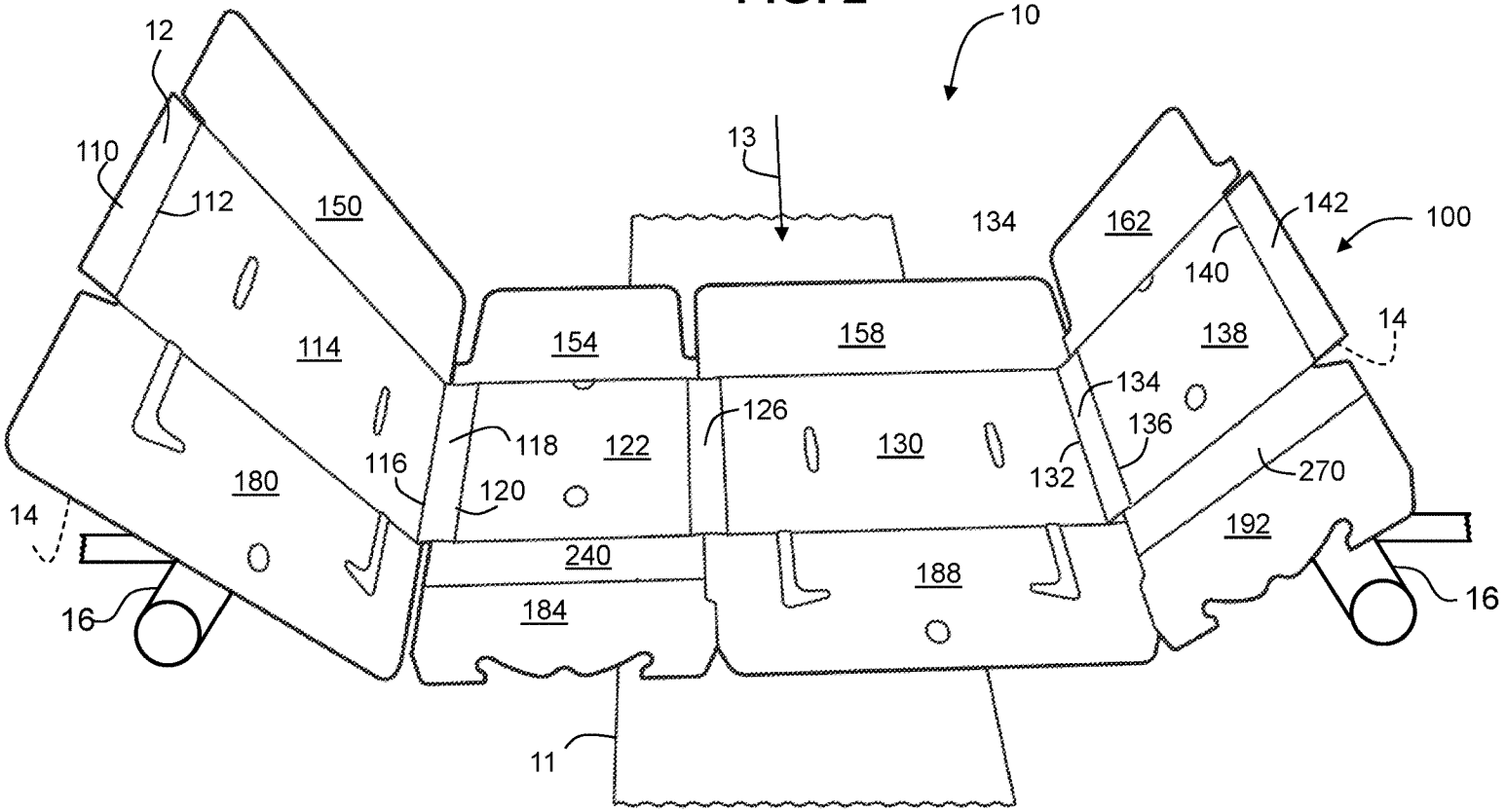
FIG. 2 is a top perspective view of the example blank shown in FIG. 1 partially folded toward a knocked-down flat configuration within a folder gluer machine.
Figure 3:
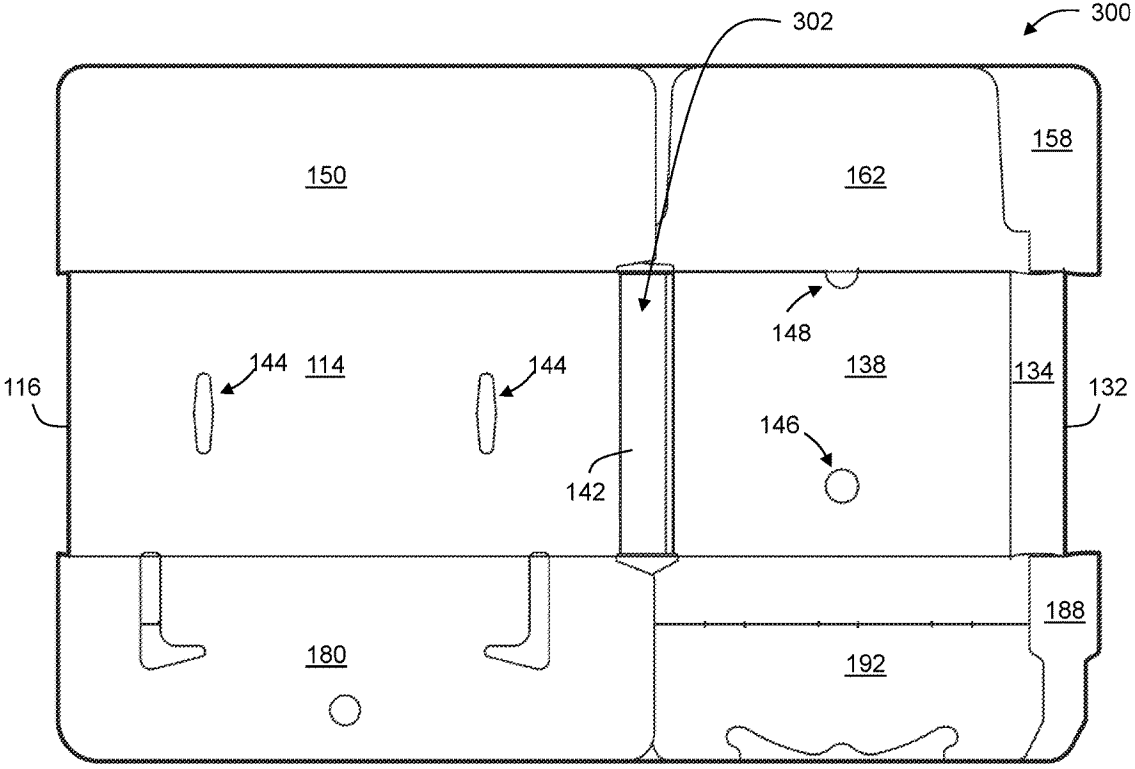
FIG. 3 is a top perspective view of a knocked-down-flat container formed from the blank shown in FIG. 1.
Figure 4:
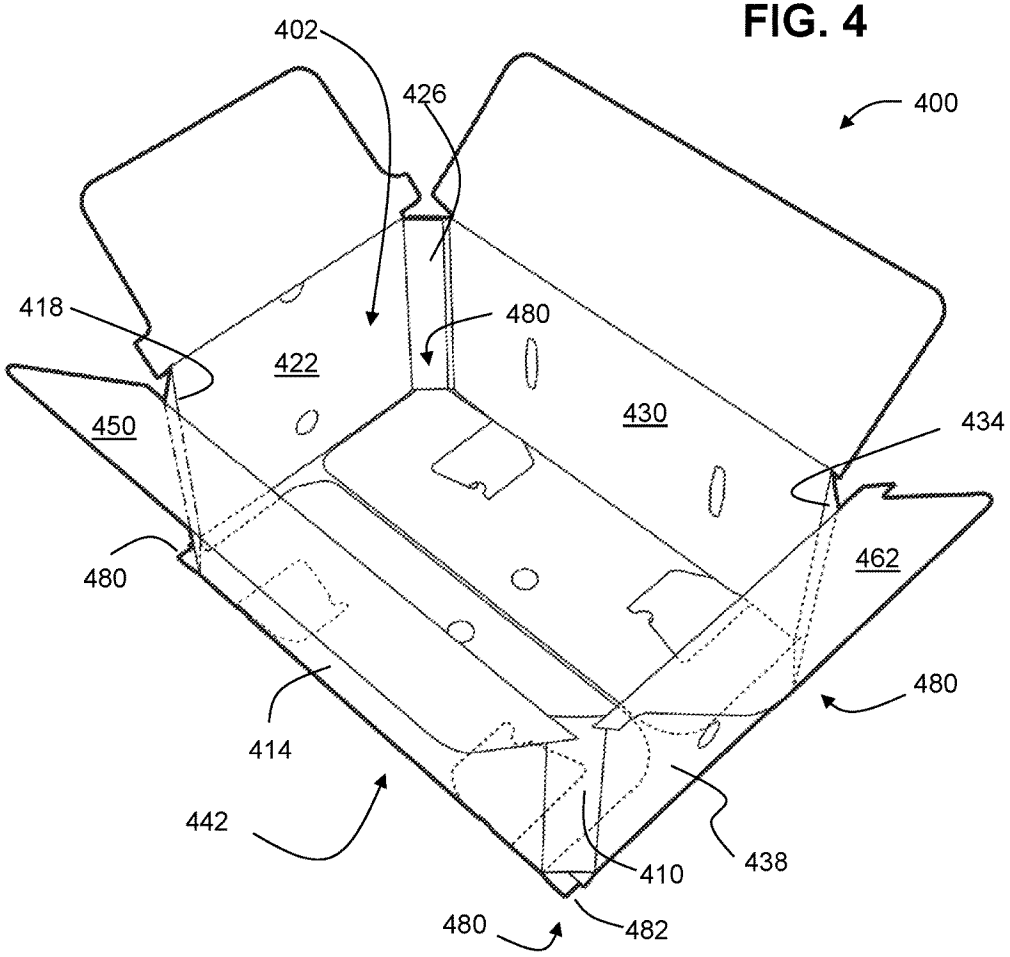
FIG. 4 a top perspective view of an erected container formed from the blank shown in FIG. 1 and/or from the knocked-down-flat container shown in FIG. 3, in an open configuration.
Figure 5:
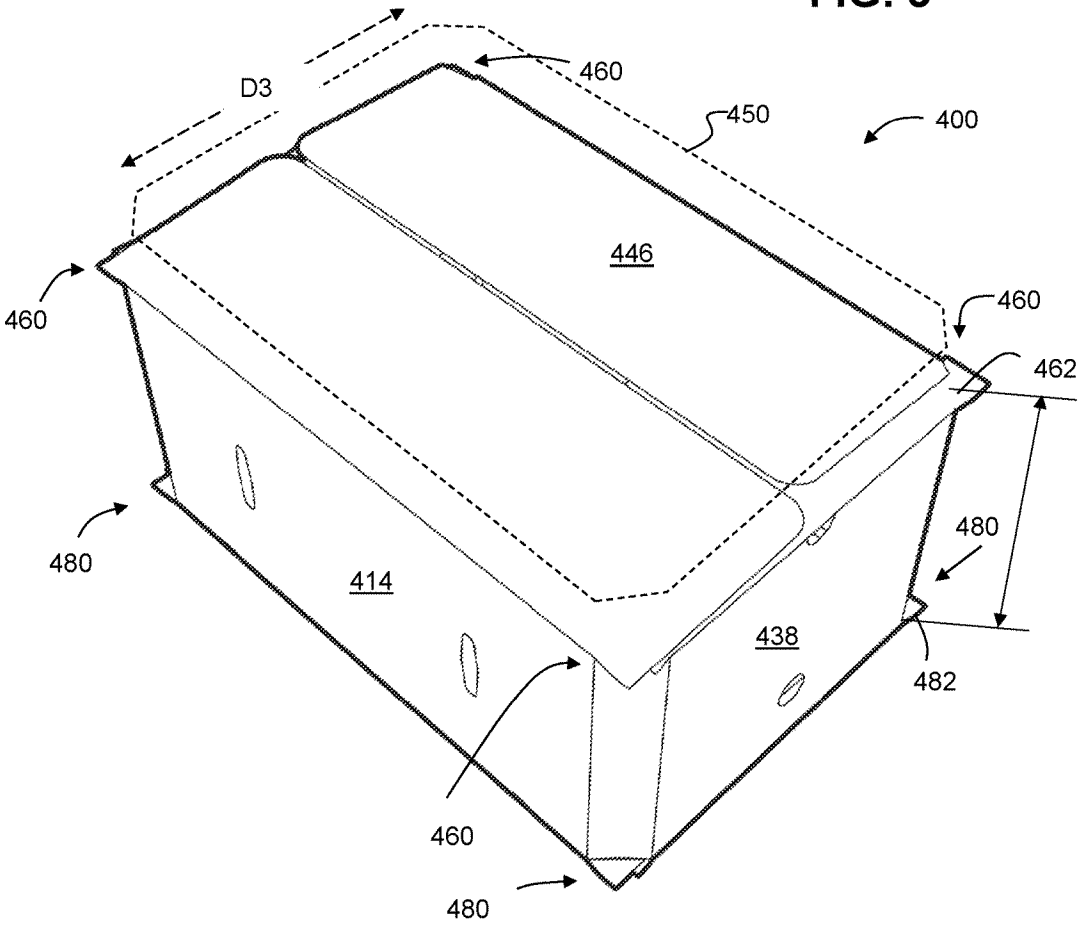
FIG. 5 is a top perspective view of the container shown in FIG. 4 with a top wall formed.

Referring now to the drawings, and more specifically to FIGS. 1-5, although as described above a container may have any suitable size, shape, and/or configuration, FIGS. 1-5 illustrate the construction or formation of a first embodiment of a container from a first embodiment of a blank. Specifically, FIG. 1 is a top plan view of an example embodiment of a blank 100 of sheet material. FIG. 2 is a top perspective view of blank 100 partially folded towards a knocked-down flat configuration within a folder-gluer machine. FIG. 3 is a top perspective view of knocked-down flat container 300 formed from blank 100. FIG. 4 is a top perspective view of an erected container 400 formed from blank 100 and/or knocked down flat container 300, in an open configuration. FIG. 5 is a top perspective view of container 400 with a top wall 446 formed.

Referring to FIG. 1, blank 100 has a first or interior surface 102 and an opposing second or exterior surface 104. Further, blank 100 defines a first edge 106 and an opposing second edge 108. In the example embodiment, blank 100 includes, from first edge 106 to second edge 108, a plurality of side panels 110, 114, 118, 122, 126, 130, 134, and 138 and a glue panel 142 coupled together in series along a plurality of preformed, generally parallel fold lines 112, 116, 120, 124, 128, 132, 136, and 140. Fold lines 112, 116, 120, 124, 128, 132, 136, and 140, as well as other fold lines and/or hinge lines described herein, may include any suitable line of weakening and/or line of separation known to those skilled in the art and guided by the teachings herein provided. In certain embodiments, however, at least one of fold lines 112, 116, 120, 124, 128, 132, 136, and 140 is preformed to have a stiffness greater than a stiffness of the others of fold lines 112, 116, 120, 124, 128, 132, 136, and 140, as will be described herein.

In the example embodiment, the plurality of side panels includes eight side panels and a glue panel. More specifically, blank 100 includes, from first edge 106 to second edge 108, a first corner panel 110, a first side panel 114, a second corner panel 118, a first end panel 122, a third corner panel 126, a second side panel 130, a fourth corner panel 134, a second end panel 138, and a glue panel 142. First side panel 114 extends from first corner panel 110 along fold line 112, second corner panel 118 extends from first side panel 114 along fold line 116, first end panel 122 extends from second corner panel 118 along fold line 120, third corner panel 126 extends from first end panel 122 along fold line 124, second side panel 130 extends from third corner panel 126 along fold line 128, fourth corner panel 134 extends from second side panel 130 along fold line 132, second end panel 138 extends from fourth corner panel 134 along fold line 136, and glue panel 142 extends from second end panel 138 along fold line 140.

In the example embodiment, each of first side panel 114 and second side panel 130 includes a pair of elongated vent holes 144, while each of first end panel 122 and second end panel 138 includes a circular vent hole 146 and a half-circular vent hole 148. It should be understood that in alternative embodiments, any panel and/or portion of blank 100 can include at least one of vent holes 144, 146, and 148 each having any suitable shape and/or configuration. In a particular embodiment, blank 100 does not include any of vent holes 144, 146, and 148.

Blank 100 also includes a plurality of top panels 150, 154, 158, and 162. Each of the plurality of top panels 150, 154, 158, and 162 extends from a top edge of a corresponding one of the plurality of side panels 110, 114, 118, 122, 126, 130, 134, and 138. In the example embodiment, the plurality of top panels includes a first top side panel 150, a first top end panel 154, a second top side panel 158, and a second top end panel 162. More specifically, first top side panel 150 extends from a top edge of first side panel 114 defined by a fold line 152, first top end panel 154 extends from a top edge of first end panel 122 defined by a fold line 156, second top side panel 158 extends from a top edge of second side panel 130 defined by a fold line 160, and second top end panel 162 extends from a top edge of second end panel 138 defined by a fold line 164. Each of fold lines 152, 156, 160, and 164 is generally perpendicular to fold lines 112, 116, 120, 124, 128, 132, 136, and 140.

In certain embodiments, at least one of the plurality of top panels 150, 154, 158, and 162 includes at least one top corner portion 170 that extends adjacent to and above a free top edge 172 of a corresponding one of corner panels 110, 118, 126, and 134 and glue panel 142. When container 400 is erected from blank 100, each top corner portion 170 is configured to extend beyond a boundary 450 defined by a plurality of side walls of container 400 to at least partially form a top stacking platform 462, as will be described herein. For purposes of this disclosure, top corner portion 170 extends "above" free top edge 172 of a corresponding one of the corner panels where top corner portion 170 is located between the two of fold lines 112, 116, 120, 124, 128, 132, 136, and 140, leading edge 106, and trailing edge 108, extended, that define the corresponding one of corner panels 110, 118, 126, and 134 and glue panel 142.

In the example embodiment, first top side panel 150 includes a first top corner portion 170 adjacent to and above free top edge 172 of first corner panel 110. That is, first corner panel 110 is defined by leading edge 106 and fold line 112, and first top corner portion 170 of first top side panel 150 lies between leading edge 106 extended and fold line 112 extended. Additionally in the example embodiment, first top side panel 150 includes a second top corner portion 170 adjacent to and above free top edge 172 of second corner panel 118. That is, second corner panel 118 is defined by fold line 116 and fold line 120, and second top corner portion 170 of first top side panel 150 lies between fold line 116 extended and fold line 120 extended.

Similarly in the example embodiment, first top end panel 154 includes a first top corner portion 170 adjacent to and above free top edge 172 of second corner panel 118 and a second top corner portion 170 adjacent to and above free top edge 172 of third corner panel 126. Second top side panel 158 includes a first top corner portion 170 adjacent to and above free top edge 172 of third corner panel 126 and a second top corner portion 170 adjacent to and above free top edge 172 of fourth corner panel 134. Second top end panel 162 includes a first top corner portion 170 adjacent to and above free top edge 172 of fourth corner panel 134 and a second top corner portion 170 adjacent to and above free top edge 172 of glue panel 142.

In the example embodiment, first top side panel 150 has a depth D1 that is about half of depth D3 of container 400 (shown in FIG. 5). Alternatively, first top side panel 150 has any suitable depth that enables blank 100 and/or container 400 to function as described herein. Similarly, in the example embodiment, second top side panel 158 has depth D1. Alternatively, second top side panel 158 has any suitable depth, such as a depth other than depth D1, that enables blank 100 and/or container 400 to function as described herein.

Blank 100 further includes a plurality of bottom panels 180, 184, 188, and 192. Each of the plurality of bottom panels 180, 184, 188, and 192 extends from a bottom edge of a corresponding one of the plurality of side panels 110, 114, 118, 122, 126, 130, 134, and 138. In the example embodiment, the plurality of bottom panels includes a first bottom side panel 180, a first bottom end panel 184, a second bottom side panel 188, and a second bottom end panel 192. More specifically, first bottom side panel 180 extends from a bottom edge of first side panel 114 defined by a fold line 182, first bottom end panel 184 extends from a bottom edge of first end panel 122 defined by a fold line 186, second bottom side panel 188 extends from a bottom edge of second side panel 130 defined by a fold line 190, and second bottom end panel 192 extends from a bottom edge of second end panel 138 defined by a fold line 194. Each of fold lines 182, 186, 190, and 194 is generally perpendicular to fold lines 112, 116, 120, 124, 128, 132, 136, and 140.

In certain embodiments, at least one of the plurality of bottom panels 180, 184, 188, and 192 includes at least one bottom corner portion 200 that extends adjacent to and beneath a free bottom edge 202 of a corresponding one of corner panels 110, 118, 126, and 134 and glue panel 142. When container 400 is erected from blank 100, each bottom corner portion 200 is configured to extend beyond boundary 450 to at least partially form a bottom stacking platform 482, as will be described herein. For purposes of this disclosure, bottom corner portion 200 extends "beneath" free bottom edge 202 of a corresponding one of the corner panels where bottom corner portion 200 is located between the two of fold lines 112, 116, 120, 124, 128, 132, 136, and 140, leading edge 106, and trailing edge 108, extended, that define the corresponding one of corner panels 110, 118, 126, and 134 and glue panel 142.

In the example embodiment, first bottom side panel 180 includes a first bottom corner portion 200 adjacent to and beneath free bottom edge 202 of first corner panel 110. That is, first corner panel 110 is defined by leading edge 106 and fold line 112, and first bottom corner portion 200 of first bottom side panel 180 lies between leading edge 106 extended and fold line 112 extended. Additionally in the example embodiment, first bottom side panel 180 includes a second bottom corner portion 200 adjacent to and beneath free bottom edge 202 of second corner panel 118. That is, second corner panel 118 is defined by fold line 116 and fold line 120, and first bottom corner portion 200 of first bottom side panel 180 lies between fold line 116 extended and fold line 120 extended.

Similarly in the example embodiment, first bottom end panel 184 includes a first bottom corner portion 200 adjacent to and beneath free bottom edge 202 of second corner panel 118 and a second bottom corner portion 200 adjacent to and beneath free bottom edge 202 of third corner panel 126. Second bottom side panel 188 includes a first bottom corner portion 200 adjacent to and beneath free bottom edge 202 of third corner panel 126 and a second bottom corner portion 200 adjacent to and beneath free bottom edge 202 of fourth corner panel 134. Second bottom end panel 192 includes a first bottom corner portion 200 adjacent to and beneath free bottom edge 202 of fourth corner panel 134 and a second bottom corner portion 200 adjacent to and beneath free bottom edge 202 of glue panel 142.

In the example embodiment, first bottom side panel 180 has a depth D2 that is about half of depth D3 of container 400 (shown in FIG. 5). Alternatively, first bottom side panel 180 has any suitable depth that enables blank 100 and/or container 400 to function as described herein. Similarly, in the example embodiment, second bottom side panel 188 has depth D2. Alternatively, second bottom side panel 188 has any suitable depth, such as a depth other than depth D2, that enables blank 100 and/or container 400 to function as described herein.

In certain embodiments, the plurality of bottom panels 180, 184, 188, and 192 includes a bottom locking mechanism 280. In the example embodiment, first bottom side panel 180 includes a first locking slot 210 and a second locking slot 212 that form a portion of bottom locking mechanism 280. Each locking slot 210 and 212 is generally L-shaped, and second locking slot 212 is a mirror-image of first locking slot 210. Similarly, in the example embodiment, second bottom side panel 188 includes a third locking slot 214 and a fourth locking slot 216 that form a portion of bottom locking mechanism 280. Each locking slot 214 and 216 is generally L-shaped, and fourth locking slot 216 is a mirror-image of third locking slot 214.

Further in the example embodiment, first bottom end panel 184 includes a free edge 218 that defines a first locking tab 220 and a second locking tab 222. Locking tabs 220 and 222 form a portion of bottom locking mechanism 280. More specifically, locking tab 220 is configured to be received by locking slot 212 and locking tab 222 is configured to be received by locking slot 214 when container 400 is erected. Free edge 218 includes a first angled portion 224, a first horizontal portion 226, a first notch 228, a middle indent 230, a second notch 232, a second horizontal portion 234, and a second angled portion 236. First locking tab 220 is defined by first angled portion 224, first horizontal portion 226, and first notch 228, and second locking tab 222 is defined by second notch 232, second horizontal portion 234, and second angled portion 236. Alternatively, locking tabs 220 and/or 222 and/or free edge 218 have any suitable configuration that enables blank 100 and/or container 400 to function as described herein. Further, in an alternative embodiment, middle indent 230 is not defined by free edge 218.

In the example embodiment, first bottom end panel 184 further includes a line of weakness 238 extending across first bottom end panel 184 substantially parallel to fold line 186. Line of weakness 238 divides first bottom end panel 184 into a first portion 240 extending from fold line 186 and a second portion 242 extending from line of weakness 238 to free edge 218. Line of weakness 238 is configured to facilitate insertion of locking tabs 220 and 222 into locking slots 212 and 214, respectively, to erect container 400. In an alternative embodiment, first bottom end panel 184 does not include line of weakness 238.

Similarly, in the example embodiment, second bottom end panel 192 includes a free edge 248 that defines a third locking tab 250 and a fourth locking tab 252. Locking tabs 250 and 252 form a portion of bottom locking mechanism 280. More specifically, locking tab 250 is configured to be received by locking slot 216 and locking tab 252 is configured to be received by locking slot 210 when container 400 is erected. Free edge 248 includes a first angled portion 254, a first horizontal portion 256, a first notch 258, a middle indent 260, a second notch 262, a second horizontal portion 264, and a second angled portion 266. Third locking tab 250 is defined by first angled portion 254, first horizontal portion 256, and first notch 258, and fourth locking tab 252 is defined by second notch 262, second horizontal portion 264, and second angled portion 266. Alternatively, locking tabs 250 and/or 252 and/or free edge 248 have any suitable configuration that enables blank 100 and/or container 400 to function as described herein. Further, in an alternative embodiment, middle indent 260 is not defined by free edge 248.

In the example embodiment, second bottom end panel 192 further includes a line of weakness 268 extending across second bottom end panel 192 substantially parallel to fold line 194. Line of weakness 268 divides second bottom end panel 192 into a first portion 270 extending from fold line 194 and a second portion 272 extending from line of weakness 268 to free edge 248. Line of weakness 268 is configured to facilitate insertion of locking tabs 250 and 252 into locking slots 216 and 210, respectively, to erect container 400. In an alternative embodiment, second bottom end panel 192 does not include line of weakness 268.

Thus, in the example embodiment, locking mechanism 280 includes locking slots 210, 212, 214, and 216 and locking tabs 220, 222, 250, and 252. In alternative embodiments, bottom locking mechanism 280 includes any suitable components and/or configuration that enables container 400 to be formed from blank 100.

With reference to FIGS. 1-3, blank 100 is rotatable about two of fold lines 112, 116, 120, 124, 128, 132, 136, and 140 to form a knocked-down-flat container 300. The two of fold lines 112, 116, 120, 124, 128, 132, 136, and 140 are chosen such that interior surface 12 of first corner panel 110 is moved into substantially face-to-face contact with exterior surface 14 of glue panel 142. In certain embodiments, first corner panel 110 is coupled to glue panel 142 to form a manufacturing joint 302. For example, an adhesive is disposed on at least one of interior surface 12 of first corner panel 110 and exterior surface 14 of glue panel 142 prior to rotation about the two fold lines. Alternatively, first corner panel 110 is coupled to glue panel 142 to form manufacturing joint 302 in any other suitable fashion, such as using fasteners and/or tape.

To form knocked-down-flat container 300 in the example embodiment, blank 100 is rotated about fold line 132 such that interior surface 12 of glue panel 142, second end panel 138, and fourth corner panel 134 are in substantially face-to-face contact with interior surface 12 of second side panel 130. Blank 100 also is rotated about fold line 116 such that interior surface 12 of first side panel 114 is in substantially face-to-face contact with interior surface 12 of second corner panel 118, first end panel 122, third corner panel 126, and second side panel 130, and interior surface 12 of first corner panel 110 is in substantially face-to-face contact with exterior surface 14 of glue panel 142. An adhesive disposed on at least one of interior surface 12 of first corner panel 110 and exterior surface 14 of glue panel 142 is used to couple first corner panel 110 and glue panel 142 together to form manufacturing joint 302.

Forming knocked-down flat container 300 also rotates interior surface 12 of first bottom side panel 180 into substantially face-to-face contact with interior surface 12 of first bottom end panel 184, and rotates interior surface 12 of second bottom end panel 192 into substantially face-to-face contact with interior surface 12 of second bottom side panel 188. Similarly, forming knocked-down flat container 300 also rotates interior surface 12 of first top side panel 150 into substantially face-to-face contact with interior surface 12 of first top end panel 154, and rotates interior surface 12 of second top end panel 162 into substantially face-to-face contact with interior surface 12 of second top side panel 158.

In certain embodiments, at least one of fold lines 112, 116, 120, 124, 128, 132, 136, and 140 is formed with an increased stiffness as compared to the others of fold lines 112, 116, 120, 124, 128, 132, 136, and 140. The increased stiffness inhibits unintended rotation of the blank about the at least one of fold lines 112, 116, 120, 124, 128, 132, 136, and 140, such as while the blank moves through a folder-gluer machine, such as a folder-gluer machine designed to form four-sided containers. For example, the at least one of fold lines 112, 116, 120, 124, 128, 132, 136, and 140 having an increased stiffness is other than the two of fold lines 112, 116, 120, 124, 128, 132, 136, and 140 about which blank 100 is rotated to form a knocked-down-flat container 300.

For example, FIG. 2 illustrates blank 100 moving through a folder-gluer machine 10. Folder-gluer machine 10 is any folder-gluer machine that is suitable for forming knocked-down-flat configurations of four-sided containers from blanks of sheet material. Folder-gluer machine 10 includes a suitable conveyance system 11 to move blank 100 through folder-gluer machine 10 in a direction of machine travel 13, and a plurality of folder arms 16. Plurality of folder arms 16 is configured to rotate blank 100 shown in FIG. 1 into the knocked-down-flat container 300 shown in FIG. 3 as blank 100 is moved through folder-gluer machine 10. In certain embodiments, folder-gluer machine 10 also includes an adhesive station (not shown) configured to apply adhesive to at least one of interior surface 12 of first corner panel 110 and exterior surface 14 of glue panel 142 to facilitate forming manufacturing joint 302.

In some embodiments, at least one of plurality of folder arms 16 is a stationary contoured rail that passively urges at least one of the plurality of side panels of blank 100, such as first side panel 114 and/or second end panel 138, into rotation towards another of the plurality of side panels, such as first end panel 122 and/or second side panel 130, as blank 100 is conveyed through folder-gluer machine 10. Additionally or alternatively, at least one of plurality of folder arms 16 is a movable arm that actively urges one of the plurality of side panels of blank 100 into rotation towards another of the plurality of side panels. Although only two folder arms 16 are shown in FIG. 2, it should be understood that folder-gluer machine 10 may include any suitable number of folder arms or rails 16 and/or other components that enable knocked-down-flat container 300 to be formed from blank 100 as described herein.

In the example embodiment, folder-gluer machine 10 is configured to rotate blank 100 about fold lines 132 and 116 into the knocked-down-flat configuration shown in FIG. 3. As folder arms 16 rotate blank 100 about fold lines 132 and 116 towards the knocked-down-flat configuration shown in FIG. 3, fold line 136 supports at least a portion of a weight of second end panel 138, second top end panel 162, and second bottom end panel 192. Additionally, at least one folder arm 16 imparts a force to second end panel 138. The weight and/or force may cause second end panel 138 to rotate about fold line 136, rather than solely about fold line 132 as intended. Such unintended rotation about fold line 136 potentially misaligns portions of blank 100 and/or disrupts operation of folder-gluer machine 10 during formation of knocked-down-flat container 300. In the example embodiment, fold line 136 is formed with an increased stiffness as compared to fold lines 112, 116, 120, 124, 128, 132, and 140 to inhibit unintended rotation of blank 100 about fold line 136. Thus, blank 100 facilitates a formation of an eight-sided container in a knocked-down-flat configuration using a folder-gluer machine configured for four-sided containers. In certain embodiments, the increased stiffness of fold line 136 is not so stiff as to prevent a subsequent intended rotation about fold line 136, for example when a user or another machine applies a force to erect container 400 from knocked-down-flat container 300.

In certain embodiments, the increased stiffness of the at least one of fold lines 112, 116, 120, 124, 128, 132, 136, and 140 is imparted by a method of preforming the at least one of fold lines 112, 116, 120, 124, 128, 132, 136, and 140. For example, the increased stiffness of the at least one of fold lines 112, 116, 120, 124, 128, 132, 136, and 140 is imparted during a die-cutting of blank 100. In some embodiments, the at least one of fold lines 112, 116, 120, 124, 128, 132, 136, and 140 having an increased stiffness is formed as a perforation line, and each of the others of fold lines 112, 116, 120, 124, 128, 132, 136, and 140 is formed as a folding score.

More specifically, in the example embodiment, each of fold lines 112, 116, 120, 124, 128, 132, and 140 is preformed using a 0.883-inch 8-point folding score, while fold line 136 is preformed with relatively increased stiffness during die-cutting of blank 100 as a perforation line using a 0.25-inch knife with 0.375-inch spacing. In alternative embodiments, at least one of fold lines 112, 116, 120, 124, 128, 132, and 140 is preformed using another suitable score for a fold line, such as but not limited to one of a 0.860-inch 4-point score and a 0.870-inch 4-point score. Also in alternative embodiments, fold line 136 is preformed by a perforation of another suitable knife size and/or spacing, or by any other suitable method that provides an increased stiffness relative to fold lines 112, 116, 120, 124, 128, 132, and 140. In still other alternative embodiments, the increased stiffness of the at least one of fold lines 112, 116, 120, 124, 128, 132, 136, and 140 is imparted by a method of preforming the at least one of fold lines 112, 116, 120, 124, 128, 132, 136, and 140 in another suitable fashion.

Referring to FIGS. 1 and 3-5, to construct container 400 from knocked-down-flat container 300, first side panel 114 is moved out of communication with first end panel 122, and second end panel 138 is moved out of communication with second side panel 130. For example, a user grasps at least one of vent holes 144 of first side panel 114 and vent holes 146 and 148 of second end panel 138, and pulls upwards such that first side panel 114 moves away from first end panel 122 and second end panel 138 moves away from second side panel 130. As another example, a user pushes fold line 116 and fold line 132 together, forcing first side panel 114 away from first end panel 122 and second end panel 138 away from second side panel 130. As another example, a machine (not shown) applies a vacuum suction device to at least one of first side panel 114 and second end panel 138 such that first side panel 114 moves away from first end panel 122 and second end panel 138 moves away from second side panel 130. In alternative embodiments, first side panel 114 is moved away from first end panel 122 and second end panel 138 is moved away from second side panel 130 in any suitable fashion.

Moving first side panel 114 out of communication with first end panel 122, and second end panel 138 out of communication with second side panel 130, also moves first bottom side panel 180 out of communication with first bottom end panel 184, and moves second bottom end panel 192 out of communication with second bottom side panel 188. Similarly, moving first side panel 114 out of communication with first end panel 122 and second end panel 138 out of communication with second side panel 130 also moves first top side panel 150 out of communication with first top end panel 154, and moves second top end panel 162 out of communication with second top side panel 158.

To continue construction of container 400 in the example embodiment, first bottom side panel 180 is rotated about fold line 182 toward interior surface 102 of first side panel 114, and second bottom side panel 188 is rotated about fold line 190 toward interior surface 102 of second side panel 130, such that first bottom side panel 180 is substantially perpendicular to first side panel 114 and second bottom side panel 188 is substantially perpendicular to second side panel 130. First bottom end panel 184 is rotated about fold line 186 toward interior surface 102 of first end panel 122. Second portion 242 of first bottom end panel 184 is rotated slightly about line of weakness 238 toward interior surface 102 of first portion 240. In the example embodiment, first bottom end panel 184 is not folded sufficiently to crease line of weakness 238 when second portion 242 is rotated toward first portion 240. Rather, the slight rotation of second portion 242 facilitates inserting first locking tab 220 into second locking slot 212 and inserting second locking tab 222 into third locking slot 214.

Similarly, second bottom end panel 192 is rotated about fold line 194 toward interior surface 102 of second end panel 138. Second portion 272 of second bottom end panel 192 is rotated slightly about line of weakness 268 toward interior surface 102 of first portion 270. In the example embodiment, second bottom end panel 192 is not folded sufficiently to crease line of weakness 268 when second portion 272 is rotated toward first portion 270. Rather, the slight rotation of second portion 272 facilitates inserting third locking tab 250 into fourth locking slot 216 and inserting fourth locking tab 252 into first locking slot 210.

First locking tab 220 and second locking tab 222 are inserted into second locking slot 212 and third locking slot 214, respectively, such that first notch 228 cooperates with second locking slot 212 and second notch 232 cooperates with third locking slot 214 to couple first bottom end panel 184 to each of first bottom side panel 180 and second bottom side panel 188. Similarly, third locking tab 250 and fourth locking tab 252 are inserted into fourth locking slot 216 and first locking slot 210, respectively, such that first notch 258 cooperates with fourth locking slot 216 and second notch 262 cooperates with first locking slot 210 to couple second bottom end panel 192 to each of first bottom side panel 180 and second bottom side panel 188.

Moreover, the elements of bottom locking mechanism 280 are configured such that each of bottom panels 180, 184, 188, and 192 is substantially perpendicular to each of side panels 110, 114, 118, 122, 126, 130, 134, and 138 when bottom panels 180, 184, 188, and 192 are coupled together. More specifically, in the example embodiment, when each of locking tabs 220, 222, 250, and 252 is inserted into the respective one of locking slots 212, 214, 216 and 210 such that bottom panels 180, 184, 188, and 192 are coupled together, each of bottom panels 180, 184, 188, and 192 is forced into a substantially perpendicular relationship to each of side panels 110, 114, 118, 122, 126, 130, 134, and 138. Bottom panels 180, 184, 188, and 192 form a bottom wall 442 of container 400.

In the example embodiment, container 400 also includes eight side walls. More specifically, container 400 includes a first corner wall 410, a first side wall 414, a second corner wall 418, a first end wall 422, a third corner wall 426, a second side wall 430, a fourth corner wall 434, and a second end wall 438. First corner wall 410 includes first corner panel 110 and glue panel 142, first side wall 414 includes first side panel 114, second corner wall 418 includes second corner panel 118, first end wall 422 includes first end panel 122, third corner wall 426 includes third corner panel 126, second side wall 430 includes second side panel 130, fourth corner wall 434 includes fourth corner panel 134, and second end wall 438 includes second end panel 138.

In the example embodiment, first corner wall 410 and third corner wall 426 are oppositely disposed and substantially parallel, first side wall 414 and second side wall 430 are oppositely disposed and substantially parallel, second corner wall 418 and fourth corner wall 434 are oppositely disposed and substantially parallel, and first end wall 422 and second end wall 438 are oppositely disposed, substantially parallel, and each substantially perpendicular to first side wall 414 and second side wall 430. In alternative embodiments, at least one pair from among first corner wall 410 and third corner wall 426, first side wall 414 and second side wall 430, second corner wall 418 and fourth corner wall 434, and first end wall 422 and second end wall 438 are not substantially parallel.

Side walls 410, 414, 418, 422, 426, 430, 434, and 438 cooperate to define a cavity 402 of container 400. Side walls 410, 414, 418, 422, 426, 430, 434, and 438 also cooperate to define a closed, eight-sided geometric boundary 450 (illustrated in FIG. 5) of container 400, wherein each of the eight sides of boundary 450 extends in a plane parallel to a corresponding one of side walls 410, 414, 418, 422, 426, 430, 434, and 438. Bottom wall 442 includes at least one bottom corner platform portion 480. Each at least one bottom corner platform portion 480 is disposed proximate a bottom edge of a respective one of corner walls 410, 418, 426, and 434. Each at least one bottom corner platform portion 480 extends outside boundary 450. Each at least one bottom corner platform portion 480 is formed by bottom corner portion 200 of at least one of plurality of bottom panels 180, 184, 188, and 192. Bottom wall 442, including the at least one bottom corner platform portion 480, defines a bottom stacking platform 482 of container 400.

In the example embodiment, bottom wall 442 includes four bottom corner platform portions 480 each proximate a bottom edge of a respective one of corner walls 410, 418, 426, and 434. Each of the four bottom corner platform portions 480 is shaped such that bottom stacking platform 482 has a generally rectangular shape, with the corners of the rectangular shape extending outside boundary 450.

To form top wall 446 of container 400 in the example embodiment, first top end panel 154 is rotated about fold line 156 toward interior surface 102 of first end panel 122, and second top end panel 162 is rotated about fold line 164 toward interior surface 102 of second end panel 138, such that first top end panel 154 is substantially perpendicular to first end panel 122 and second top end panel 162 is substantially perpendicular to second end panel 138. First top side panel 150 is rotated about fold line 152 toward interior surface 102 of first side panel 114, and second top side panel 158 is rotated about fold line 160 toward interior surface 102 of second side panel 130, such that first top side panel 150 is substantially perpendicular to first side panel 114 and second top side panel 158 is substantially perpendicular to second side panel 130. Top wall 446 includes first top side panel 150, second top side panel 158, first top end panel 154, and second top end panel 162. In certain embodiments, at least two of first top side panel 150, second top side panel 158, first top end panel 154, and second top end panel 162 are coupled together to secure top wall 446, for example during shipping and storage of container 400. For example, first top side panel 150 and second top side panel 158 coupled together using tape. For another example, an adhesive is used to coupled interior surface 102 of each first top side panel 150 and second top side panel 158 to exterior surface 104 of each of first top end panel 154 and second top end panel 162. In alternative embodiments, at least two of first top side panel 150, second top side panel 158, first top end panel 154, and second top end panel 162 are coupled together in any suitable fashion that enables container 400 to function as described herein. In still other alternative embodiments, none of first top side panel 150, second top side panel 158, first top end panel 154, and second top end panel 162 are coupled together.

Top wall 446 includes at least one top corner platform portion 460. Each at least one top corner platform portion 460 is disposed proximate a top edge of a respective one of corner walls 410, 418, 426, and 434. Each at least one top corner platform portion 460 extends outside boundary 450. Each at least one top corner platform portion 460 is formed by top corner portion 170 of at least one of plurality of top panels 150, 154, 158, and 162. Top wall 446, including the at least one top corner platform portion 460, defines a top stacking platform 462 of container 400.

In the example embodiment, top wall 446 includes four top corner platform portions 460 each proximate a top edge of a respective one of corner walls 410, 418, 426, and 434. Each of the top bottom corner platform portions 460 is shaped such that top stacking platform 462 has a generally rectangular shape, with the corners of the rectangular shape extending outside boundary 450.

Figure 6:
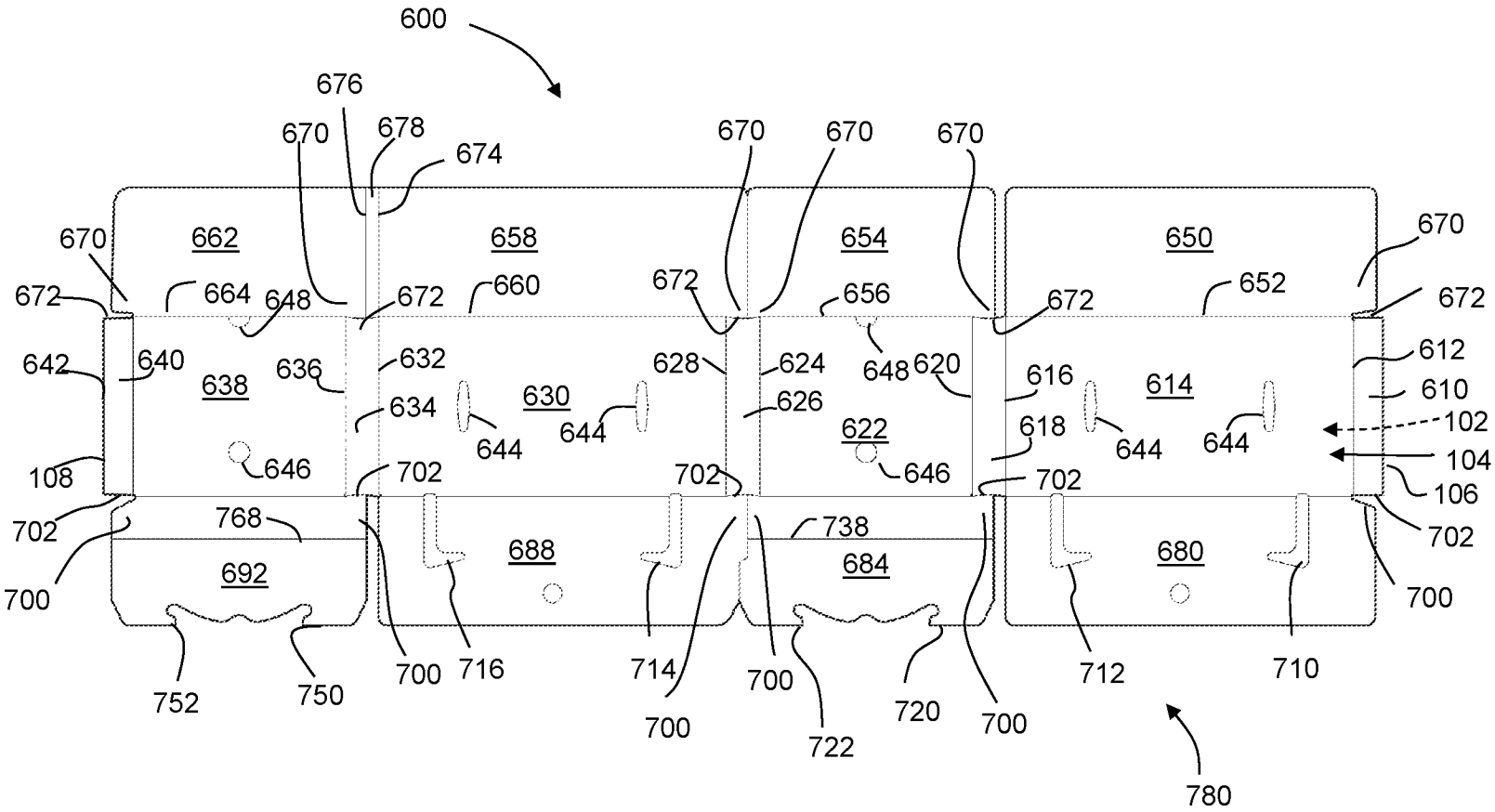
FIG. 6 is a top plan view of a second example embodiment of a blank of sheet material.
Figure 7:
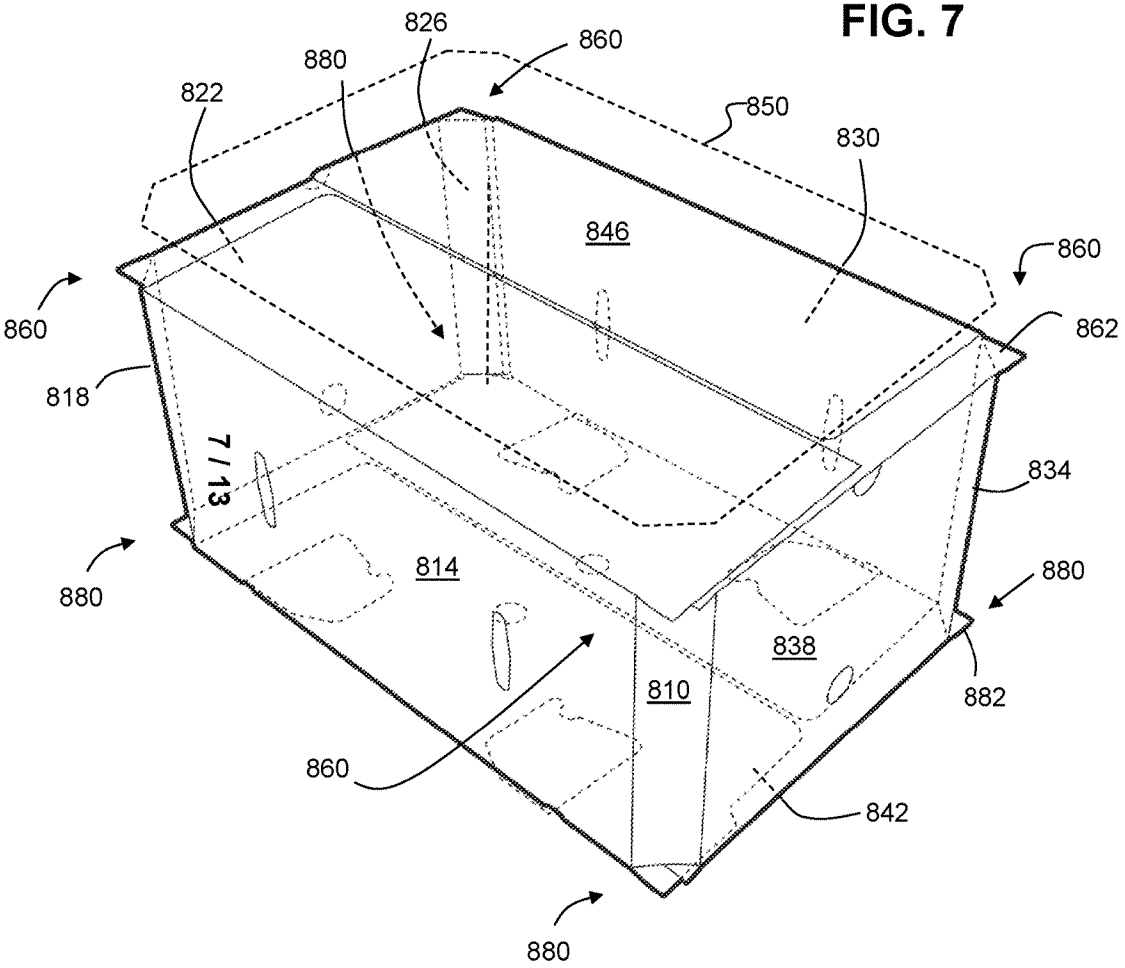
FIG. 7 is a top perspective view of a container formed from the blank shown in FIG. 6.

FIGS. 6 and 7 illustrate a second embodiment of a blank used to form a second embodiment of a container. Specifically, FIG. 6 is a top plan view of an example embodiment of a blank 600 of sheet material. FIG. 7 is a top perspective view of a container 800 formed from blank 600.

Blank 600 is similar in many respects to blank 100, but blank 600 has a different arrangement of top panels, as will be described herein. Like blank 100, blank 600 has first or interior surface 102 and opposing second or exterior surface 104, and defines first edge 106 and opposing second edge 108. In the example embodiment, similar to blank 100, blank 600 includes, from first edge 106 to second edge 108, a plurality of side panels 610, 614, 618, 622, 626, 630, 634, and 638 coupled together in series along a plurality of preformed, generally parallel fold lines 612, 616, 620, 624, 628, 632, 636, and 640. In the example embodiment, the plurality of side panels includes, from first edge 106 to second edge 108, a first corner panel 610, a first side panel 614, a second corner panel 618, a first end panel 622, a third corner panel 626, a second side panel 630, a fourth corner panel 634, a second end panel 638, and a glue panel 642. Also like blank 100, blank 600 also includes elongated vent holes 644, circular vent holes 646, and half-circular vent holes 648. It should be understood that in alternative embodiments, any panel and/or portion of blank 600 can include at least one of vent holes 644, 646, and 648 each having any suitable shape and/or configuration. In a particular embodiment, blank 600 does not include any of vent holes 644, 646, and 648.

Also like blank 100, in certain embodiments, at least one of fold lines 612, 616, 620, 624, 628, 632, 636, and 640 is preformed to have a stiffness greater than a stiffness of the others of fold lines 612, 616, 620, 624, 628, 632, 636, and 640. For example, blank 600 can be rotated about another two of fold lines 612, 616, 620, 624, 628, 632, 636, and 640 to form a knocked-down-flat container (not shown) in similar fashion as for knocked-down-flat container 300, and as described above for blank 100, the increased stiffness of the one of fold lines 612, 616, 620, 624, 628, 632, 636, and 640 inhibits unintended rotation of the blank about the at least one of fold line, such as while blank 600 moves through a folder-gluer machine. The at least one fold line can be formed in any suitable fashion, as described above. In the example embodiment, fold line 636 is preformed to have a stiffness greater than a stiffness of fold lines 612, 616, 620, 624, 628, 632, and 640.

Further like blank 100, blank 600 includes a plurality of bottom panels 680, 684, 688, and 692 that include a bottom locking mechanism 780, which functions in a similar fashion as bottom locking mechanism 280 described above. In the example embodiment, bottom locking mechanism 780 includes generally L-shaped mirror-image locking slots 710 and 712 on first bottom side panel 680, generally L-shaped mirror-image locking slots 714 and 716 on second bottom side panel 688, locking tabs 720 and 722 on first bottom end panel 684, and locking tabs 750 and 752 on second bottom end panel 692. In addition, bottom end panels 684 and 692 include lines of weakness 738 and 768, respectively.

In certain embodiments, at least one of the plurality of bottom panels 680, 684, 688, and 692 includes at least one bottom corner portion 700 that extends adjacent to a free bottom edge 702 of a respective one of corner panels 610, 618, 626, and 634 and glue panel 642. When container 800 is formed from blank 600, each bottom corner portion 700 is configured to extend beyond a boundary 850 defined by the plurality of side walls of container 800 to at least partially form a bottom stacking platform 882. In the example embodiment, first bottom side panel 680 includes a first bottom corner portion 700 adjacent to free bottom edge 702 of first corner panel 610. First bottom end panel 684 includes a first bottom corner portion 700 adjacent to free bottom edge 702 of second corner panel 618 and a second bottom corner portion 700 adjacent to free bottom edge 702 of third corner panel 626. Second bottom side panel 688 includes a first bottom corner portion 700 adjacent to free bottom edge 702 of third corner panel 126. Second bottom end panel 692 includes a first bottom corner portion 700 adjacent to free bottom edge 702 of fourth corner panel 634 and a second bottom corner portion 700 adjacent to free bottom edge 702 of glue panel 642.

Blank 600 also includes a plurality of top panels 650, 654, 658, and 662. In the example embodiment, the plurality of top panels includes a first top side panel 650, a first top end panel 654, a second top side panel 658, and a second top end panel 662. More specifically, first top side panel 650 extends from a top edge of first side panel 614 defined by a fold line 652, first top end panel 654 extends from a top edge of first end panel 622 defined by a fold line 656, second top side panel 658 extends from a top edge of second side panel 630 defined by a fold line 660, and second top end panel 662 extends from a top edge of second end panel 638 defined by a fold line 664. Each of fold lines 652, 656, 660, and 664 is generally perpendicular to fold lines 612, 616, 620, 624, 628, 632, 636, and 640.

In certain embodiments, at least two of plurality of top panels 650, 654, 658, and 662 are coupled together to enable an enhanced efficiency of using blank 600 with certain types of folder-gluer machines. In the example embodiment, blank 600 is configured to be rotated about fold lines 616 and 632 to form a knocked-down flat container (not shown). Rather than being separated by a full cut line, second top side panel 658 and second top end panel 662 are coupled together across a line of weakness 676 that lies between fold lines 632 and 636 extended. For at least some known folder-gluer machines, blank 600 may be more suitable than a blank, such as for example blank 100, that has an extended gap between, or allows independent movement of, adjacent top panels proximate to fold line 632.

In the example embodiment, line of weakness 676 is a segmented, or partial, cut line. At least one tab 678 couples second top side panel 658 and second top end panel 662 across line of weakness 676. For example, the at least one tab 678 is integrally formed by retaining material at a location of each tab 678 when blank 600 is die cut. In the example embodiment, the at least one tab 678 includes three tabs 678, with the two tabs 678 closest to free top edge 672 of fourth corner panel 634 each having a width of about 0.125 inches, and the remaining tab 678 having a width of about 0.1875 inches. In alternative embodiments, any suitable number of tabs 678 having any suitable width are used to couple second top side panel 658 and second top end panel 662 across the segmented, or partial, cut line defining line of weakness 676. In other alternative embodiments, segmented, line of weakness 676 is formed by another suitable structure, such as a perforation.

In certain embodiments, second top side panel 658 further includes a preformed fold line 674 defined generally parallel to, and extending from, fold line 632. Fold line 674 facilitates rotating blank 600 about fold line 632 into a knocked-down-flat configuration (not shown) while second top side panel 658 and second top end panel 662 are coupled together.

In certain embodiments, similar to blank 100, at least one of the plurality of top panels 650, 654, 658, and 662 includes at least one top corner portion 670 that extends adjacent to and above a free top edge 672 of a respective one of corner panels 610, 618, 626, and 634 and glue panel 642. When container 800 is formed from blank 600, each top corner portion 670 is configured to extend beyond boundary 850 to at least partially form a top stacking platform 862. In the example embodiment, first top side panel 650 includes a first top corner portion 670 adjacent to and above free top edge 672 of first corner panel 610. First top end panel 654 includes a first top corner portion 670 adjacent to and above free top edge 672 of second corner panel 618 and a second top corner portion 670 adjacent to and above free top edge 672 of third corner panel 626. Second top side panel 658 includes a first top corner portion 670 adjacent to and above free top edge 672 of third corner panel 626. Second top end panel 662 includes a first top corner portion 670 adjacent to and above free top edge 672 of fourth corner panel 634 and a second top corner portion 670 adjacent to and above free top edge 672 of glue panel 642.

Container 800 is similar to container 400 and includes a first corner wall 810, a first side wall 814, a second corner wall 818, a first end wall 822, a third corner wall 826, a second side wall 830, a fourth corner wall 834, and a second end wall 838. First corner wall 810 includes first corner panel 610 and glue panel 642, first side wall 814 includes first side panel 614, second corner wall 818 includes second corner panel 618, first end wall 822 includes first end panel 622, third corner wall 826 includes third corner panel 626, second side wall 830 includes second side panel 630, fourth corner wall 834 includes fourth corner panel 634, and second end wall 838 includes second end panel 638. Side walls 810, 814, 818, 822, 826, 830, 834, and 838 cooperate to define a closed, eight-sided geometric boundary 850 of container 800, wherein each of the eight sides of boundary 850 extends in a plane parallel to a corresponding one of side walls 810, 814, 818, 822, 826, 830, 834, and 838.

Bottom panels 680, 684, 688, and 692 form bottom wall 842 of container 800. Bottom wall 842 includes a bottom corner platform portion 880 proximate a bottom edge of each of corner walls 810, 818, 826, and 834. Each bottom corner platform portion 880 extends outside boundary 850. Each bottom corner platform portion 880 is formed by bottom corner portion 700 of at least one of plurality of bottom panels 680, 684, 688, and 692. Bottom wall 842, including bottom corner platform portions 880, defines a bottom stacking platform 882 of container 800, similar to bottom stacking platform 482 of container 400.

Top panels 650, 654, 658, and 662 form top wall 846 of container 800. Top wall 846 includes a top corner platform portion 860 proximate a top edge of each of corner walls 810, 818, 826, and 834. Each top corner platform portion 860 extends outside boundary 850. Each top corner platform portion 860 is formed by top corner portion 670 of at least one of plurality of top panels 650, 654, 658, and 662. Top wall 846, including top corner platform portions 860, defines a top stacking platform 862 of container 800, similar to top stacking platform 462 of container 400.

In the example embodiment, container 800 is formed from blank 600 in a similar fashion as described above for forming container 400 from blank 100. However, in certain embodiments, forming top wall 846 includes an additional step of separating second top side panel 658 and second top end panel 662 along line of weakness 676 prior to rotating each of second top side panel 658 and second top end panel 662 to be generally perpendicular to second side panel 630 and second end panel 638, respectively. For example, a user applies a force to at least one of second top side panel 658 and second top end panel 662 to separate second top side panel 658 and second top end panel 662 along line of weakness 676.

Figure 8:
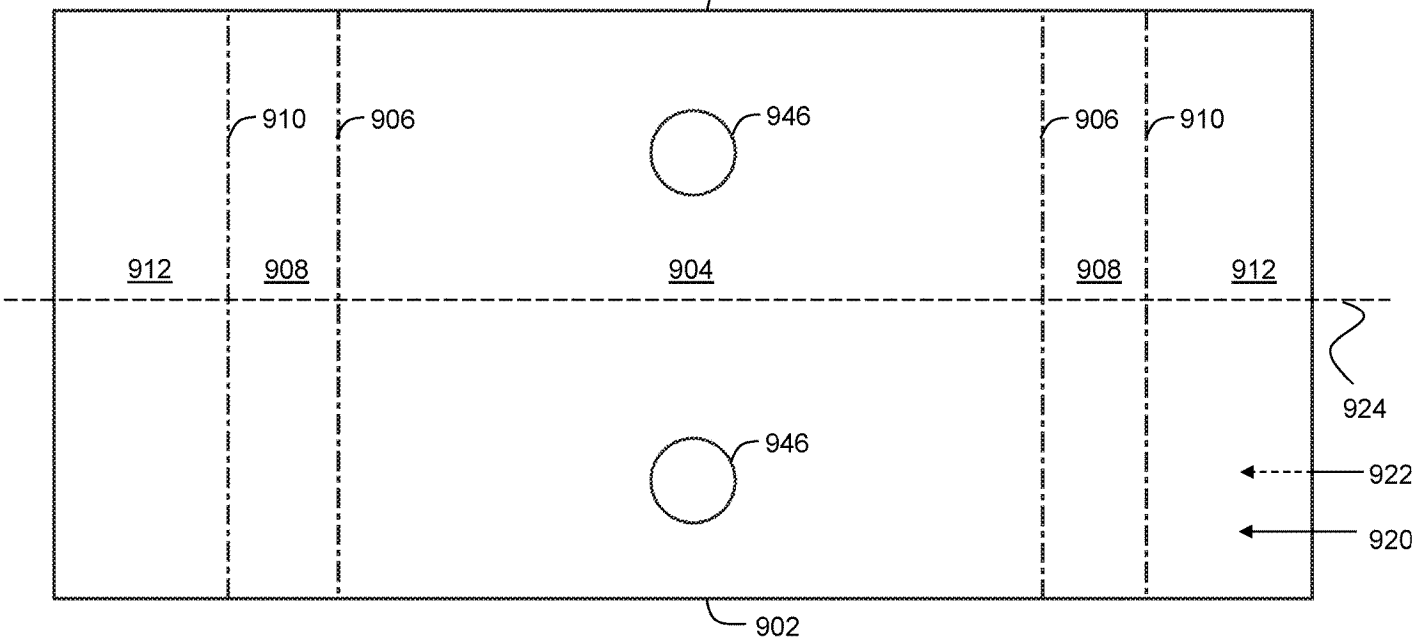
FIG. 8 is a top plan view of an example reinforcing blank of sheet material.
Figure 9:
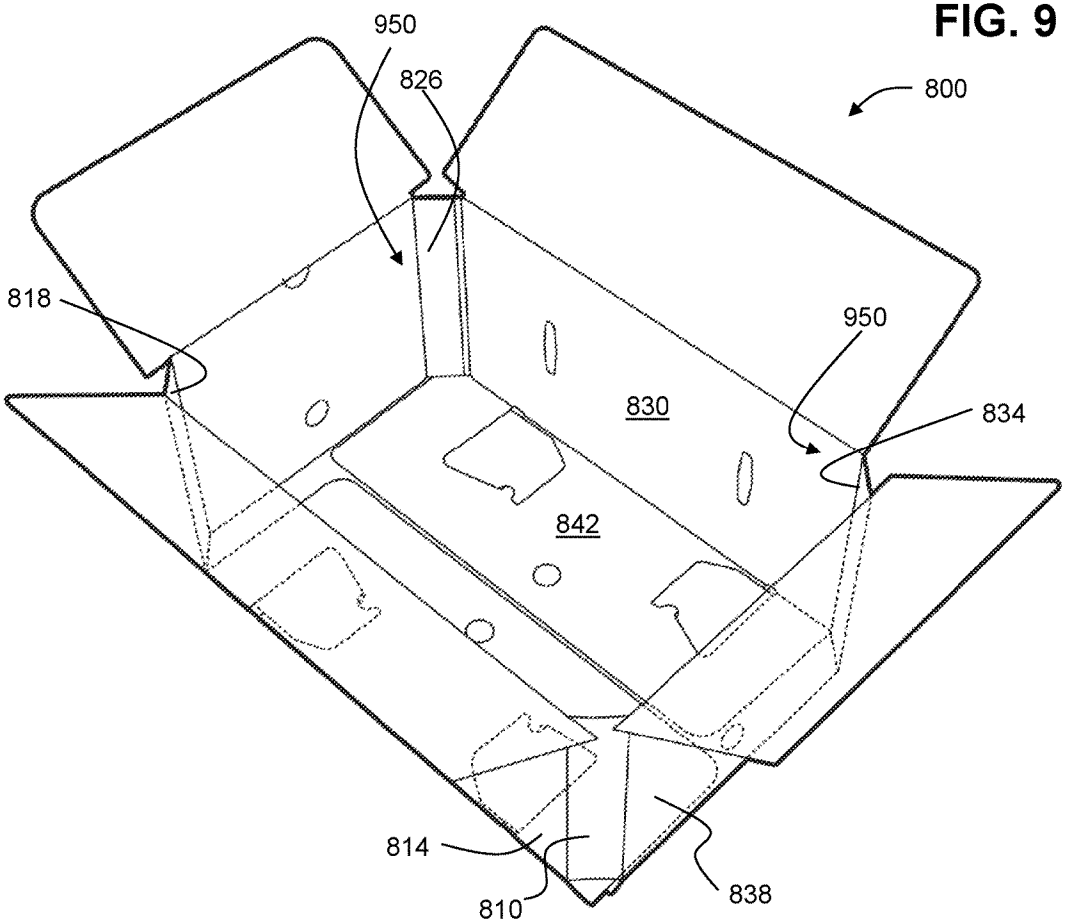
FIG. 9 is a top perspective view of the container shown in FIG. 7 with a pair of reinforcing end structures each formed from the blank shown in FIG. 8 inserted.

FIGS. 8 and 9 illustrate a container 800 that additionally includes a pair of reinforcing end structures 950. Specifically, FIG. 8 is a top plan view of an example reinforcing blank 900 of sheet material used to form each reinforcing end structure 950. FIG. 9 is a top perspective view of container 800 prior to formation of top wall 846, with a pair of reinforcing end structures 950 inserted as part of end walls 822 and 838.

With reference to FIGS. 6-9, reinforcing blank 900 includes a first, or interior, surface 920 and a second, or exterior, surface 922. Reinforcing blank 900 extends from a first edge 901 to a second edge 902. In certain embodiments, reinforcing blank 900 is symmetric about a centerline 924, such that reinforcing end structure 950 formed from reinforcing blank 900 can be equivalently positioned within container 800 with either of first edge 901 and second edge 902 adjacent bottom wall 842.

Reinforcing blank 900 includes a plurality of reinforcing panels coupled together in series along a plurality of preformed, generally parallel fold lines. In the example embodiment, the plurality of reinforcing panels includes a reinforcing end panel 904. Reinforcing end panel 904 is configured to be generally congruent to either of end panels 622 and 638 of blank 600. Reinforcing end panel 904 includes a pair of vent holes 946, and each of the pair of vent holes is configured to align with vent hole 646 of end panel 622 or 638 when a respective edge 901 or 902 is positioned adjacent bottom wall 842.

A pair of reinforcing corner panels 908 extend from respective fold lines 906 defined at opposing side edges of reinforcing end panel 904. Each corner panel 908 is configured to be generally congruent to any of first corner panel 610, second corner panel 618, third corner panel 626, and fourth corner panel 634. In the example embodiment, a pair of reinforcing side panels 912 each extends from a fold line 910 defined at a side edge of each reinforcing corner panel 908.

To form reinforcing end structure 950 from reinforcing blank 900, each reinforcing corner panel 908 is rotated about a respective fold line 906 toward interior surface 920 of reinforcing end panel 904. Each reinforcing side panel 912 also is rotated about a respective fold line 910 toward interior surface 920 of reinforcing end panel 904.

In the example embodiment, each reinforcing end panel 904 of the pair of reinforcing end structures 950 is positioned adjacent a respective one of the opposing end walls 822 and 838 of container 800. Each reinforcing end structure 950 is positioned such that one of first edge 901 and second edge 902 is adjacent bottom wall 842. In certain embodiments, each reinforcing end panel 904 is secured to a respective end wall 822 and 838, such as by at least one of an adhesive, fasteners, or in another suitable fashion that enables reinforcing end structures 950 to function as described herein. Additionally or alternatively, at least one of reinforcing corner panels 908 is secured to a respective one of corner walls 810, 818, 826, and 834. Additionally or alternatively, at least one of reinforcing side panels 912 is secured to a respective one of side walls 814 and 830. In alternative embodiments, reinforcing end structures 950 are not secured to container 800, and are maintained in position adjacent respective end walls 822 and 838 by a product disposed within container 800.

With the pair of reinforcing end structures 950 inserted, first corner wall 810 includes first corner panel 610, glue panel 642, and a first reinforcing corner panel 908 of a first of the pair of reinforcing end structures 950. First side wall 814 includes first side panel 614, a first reinforcing side panel 912 of the first reinforcing end structure 950, and a second reinforcing side panel 912 of a second of the pair of reinforcing end structures 950. Second corner wall 818 includes second corner panel 618 and a second reinforcing corner panel 908 of the second reinforcing end structure 950. First end wall 822 includes first end panel 622 and reinforcing end panel 904 of the second reinforcing end structure 950. Third corner wall 826 includes third corner panel 626 and a first reinforcing corner panel 908 of the second reinforcing end structure 950. Second side wall 830 includes second side panel 630, a first reinforcing side panel 912 of the second reinforcing end structure 950, and a second reinforcing side panel 912 of the first reinforcing end structure 950. Fourth corner wall 834 includes fourth corner panel 634 and a second reinforcing corner panel 908 of the first reinforcing end structure 950. Second end wall 838 includes second end panel 638 and reinforcing end panel 904 of the first reinforcing end structure 950.

Reinforcing end structures 950 advantageously provide increased stacking strength to container 800. In an embodiment, reinforcing end structures 950 are formed and inserted in the field into containers 800 that are positioned on one of a plurality of lower levels of a stack of containers 800, while reinforcing end structures 950 are not inserted into containers 800 that are on one of a plurality of upper levels of the stack of containers 800. In alternative embodiments, reinforcing end structures 950 are inserted into any suitable number of containers 800, including but not limited to all containers 800 and no containers 800.

Although reinforcing blank 900 and reinforcing end structures 950 are illustrated as configured for use with container 800, it should be understood that in alternative embodiments, reinforcing blank 900 and reinforcing end structures 950 are configured for use with container 400 or any other suitable embodiment of a container contemplated herein. Likewise, it should be understood that in alternative embodiments, container 800 or any other suitable embodiment of a container contemplated herein includes one or no reinforcing end structures 950.

Figure 10:
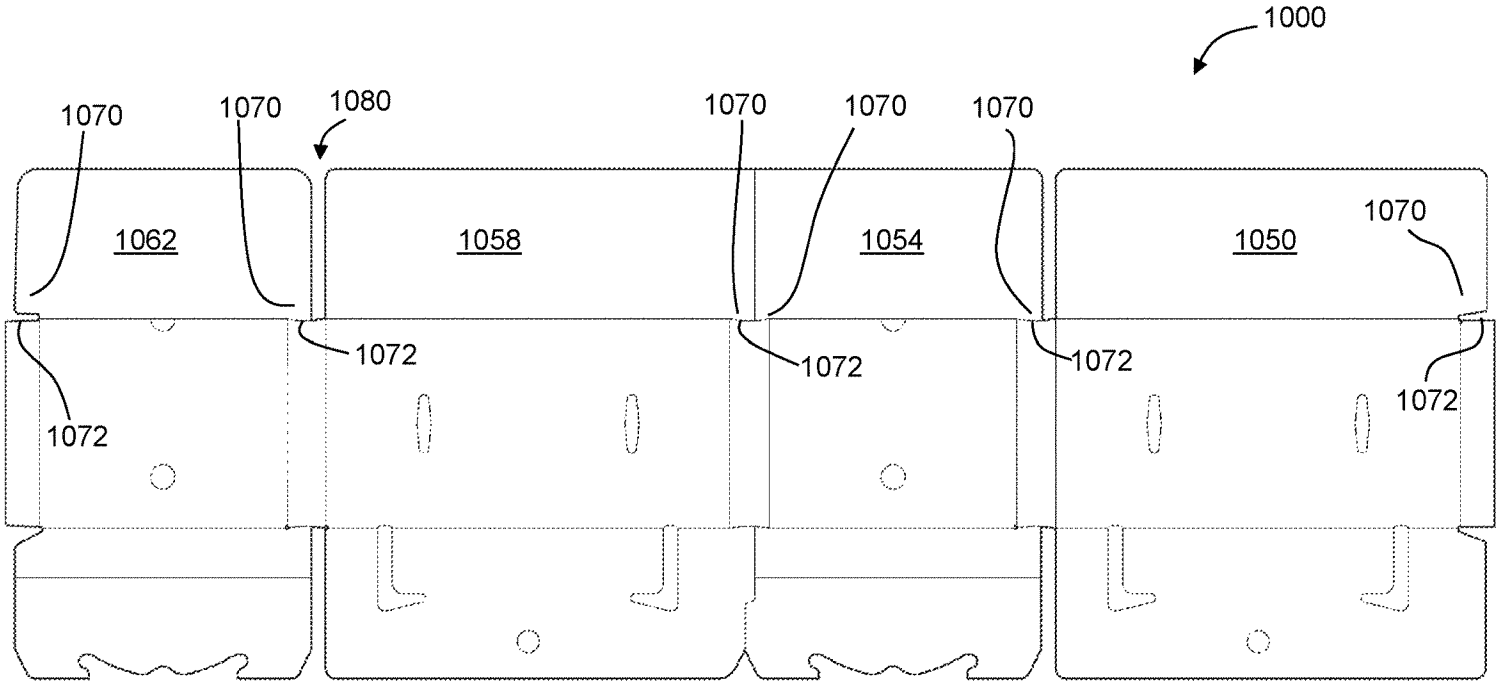
FIG. 10 is a top plan view of a third example embodiment of a blank of sheet material.

FIG. 10 is a top plan view of a third embodiment of a blank that may be used to form a third embodiment of a container. Specifically, FIG. 10 is a top plan view of an example embodiment of a blank 1000 of sheet material. With reference to FIGS. 6, 7, and 10, blank 1000 is substantially identical to blank 600 except for the plurality of top panels 1050, 1054, 1058, and 1062, and as such the other elements of blank 1000 need not be relabeled. More specifically, unlike top panels 658 and 662 of blank 600, top panels 1058 and 1062 of blank 1000 are not coupled together. Rather, a gap 1080 is preformed between top panels 1058 and 1062. A container (not shown) may be formed from blank 1000 in the same fashion as container 800 is formed from blank 600, but without requiring the extra step of separating top panels, such as top panels 658 and 662, to form the container. In certain embodiments, blank 1000 facilitates an increased efficiency of operation of a folder-gluer machine without requiring a user to perform the extra step of separating top panels, such as top panels 658 and 662, to form the container, and without embedding a fold line, such as fold line 674, within top panel 1058. Similar to blank 600, at least one of the plurality of top panels 1050, 1054, 1058, and 1062 includes at least one top corner portion 1070 that extends adjacent to and above a free top edge 1072 of a respective corner panel and/or glue panel, and each top corner portion 1070 is configured to at least partially form a top stacking platform of the container.

Figure 11:
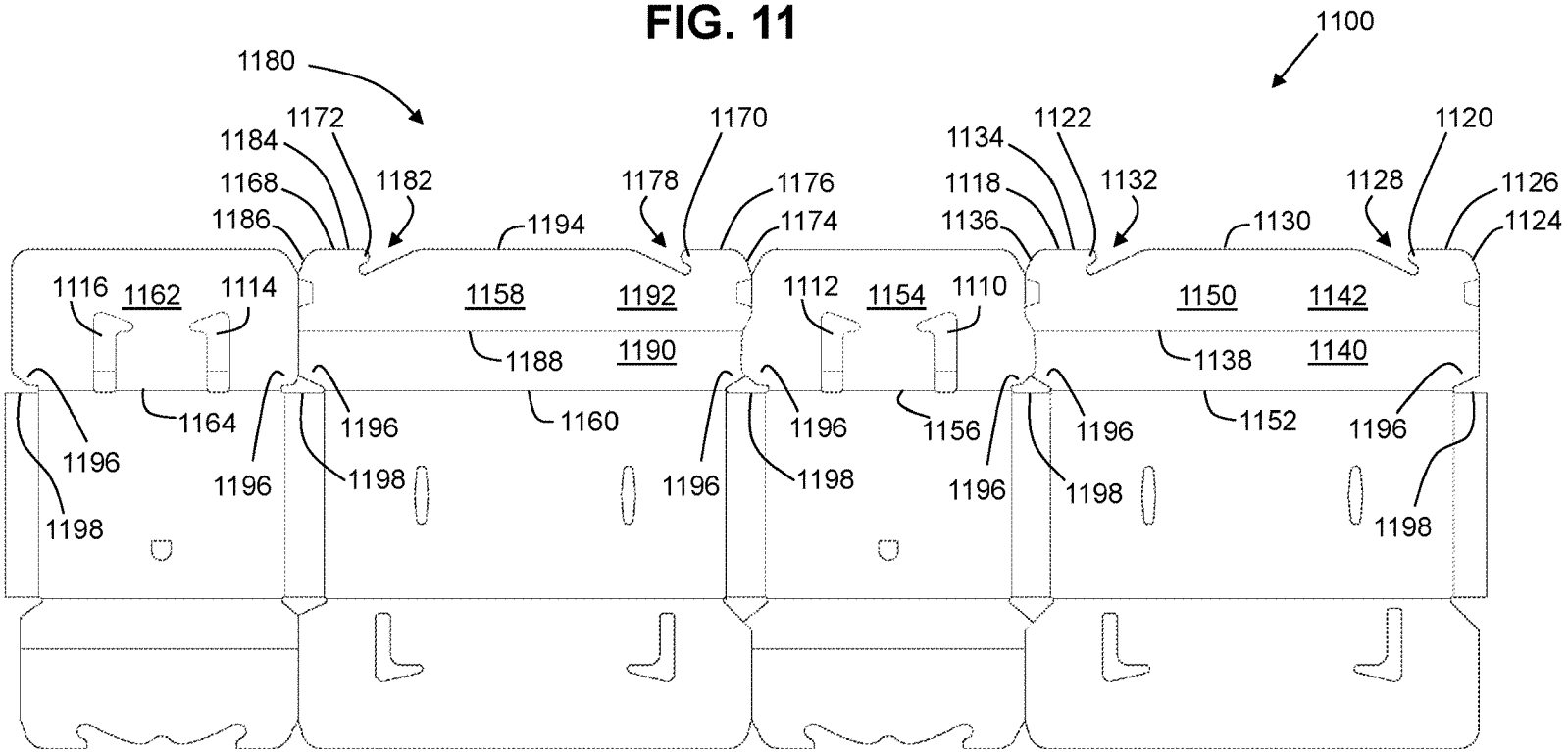
FIG. 11 is a top plan view of a fourth example embodiment of a blank of sheet material.

FIG. 11 is a top plan view of a fourth embodiment of a blank that may be used to form a fourth embodiment of a container. Specifically, FIG. 11 is a top plan view of an example embodiment of a blank 1100 of sheet material. With reference to FIGS. 1-5 and 11, blank 1100 is substantially identical to blank 100 except for the plurality of top panels 1150, 1154, 1158, and 1162, and as such the other elements of blank 1100 need not be relabeled. More specifically, plurality of top panels 1150, 1154, 1158, and 1162 include an example embodiment of a top locking mechanism, designated top locking mechanism 1180.

In the example embodiment, first top end panel 1154 includes a first locking slot 1110 and a second locking slot 1112 that form a portion of top locking mechanism 1180. Each locking slot 1110 and 1112 is generally L-shaped, and second locking slot 1112 is a mirror-image of first locking slot 1110. Similarly, in the example embodiment, second top end panel 1162 includes a third locking slot 1114 and a fourth locking slot 1116 that form a portion of top locking mechanism 1180. Each locking slot 1114 and 1116 is generally L-shaped, and fourth locking slot 1116 is a mirror-image of third locking slot 1114.

Further in the example embodiment, first top side panel 1150 includes a free edge 1118 that defines a first locking tab 1120 and a second locking tab 1122. Locking tabs 1120 and 1122 form a portion of top locking mechanism 1180. More specifically, locking tab 1120 is configured to be received by locking slot 1116 and locking tab 1122 is configured to be received by locking slot 1110 when the container (not shown) is erected. Free edge 1118 includes a first angled portion 1124, a first horizontal portion 1126, a first notch 1128, a middle horizontal portion 1130, a second notch 1132, a second horizontal portion 1134, and a second angled portion 1136. First locking tab 1120 is defined by first angled portion 1124, first horizontal portion 1126, and first notch 1128, and second locking tab 1122 is defined by second notch 1132, second horizontal portion 1134, and second angled portion 1136. Alternatively, locking tabs 1120 and/or 1122 and/or free edge 1118 have any suitable configuration that enables blank 1100 to function as described herein. Further, in an alternative embodiment, middle horizontal portion 1130 includes middle indent (not shown).

In the example embodiment, first top side panel 1150 further includes a line of weakness 1138 extending across first top side panel 1150 substantially parallel to fold line 1152. Line of weakness 1138 divides first top side panel 1150 into a first portion 1140 extending from fold line 1152 and a second portion 1142 extending from line of weakness 1138 to free edge 1118. Line of weakness 1138 is configured to facilitate insertion of locking tabs 1120 and 1122 into locking slots 1116 and 1110, respectively, to erect the container. In an alternative embodiment, first top side panel 1150 does not include line of weakness 1138.

Similarly, in the example embodiment, second top side panel 1158 includes a free edge 1168 that defines a first locking tab 1170 and a second locking tab 1172. Locking tabs 1170 and 1172 form a portion of top locking mechanism 1180. More specifically, locking tab 1170 is configured to be received by locking slot 1112 and locking tab 1172 is configured to be received by locking slot 1114 when the container is erected. Free edge 1168 includes a first angled portion 1174, a first horizontal portion 1176, a first notch 1178, a middle horizontal portion 1194, a second notch 1182, a second horizontal portion 1184, and a second angled portion 1186. First locking tab 1170 is defined by first angled portion 1174, first horizontal portion 1176, and first notch 1178, and second locking tab 1172 is defined by second notch 1182, second horizontal portion 1184, and second angled portion 1186. Alternatively, locking tabs 1170 and/or 1172 and/or free edge 1168 have any suitable configuration that enables blank 1100 to function as described herein. Further, in an alternative embodiment, middle horizontal portion 1194 includes a middle indent (not shown).

In the example embodiment, second top side panel 1158 further includes a line of weakness 1188 extending across second top side panel 1158 substantially parallel to fold line 1160. Line of weakness 1188 divides second top side panel 1158 into a first portion 1190 extending from fold line 1160 and a second portion 1192 extending from line of weakness 1188 to free edge 1168. Line of weakness 1188 is configured to facilitate insertion of locking tabs 1170 and 1172 into locking slots 1112 and 1114, respectively, to erect the container. In an alternative embodiment, second top side panel 1158 does not include line of weakness 1188.

Thus, in the example embodiment of FIG. 11, top locking mechanism 1180 includes locking slots 1110, 1112, 1114, and 1116 and locking tabs 1120, 1122, 1170, and 1172. Also, similar to blank 100, at least one of the plurality of top panels 1150, 1154, 1158, and 1162 includes at least one top corner portion 1196 that extends adjacent to and above a free top edge 1198 of a respective corner panel and/or glue panel, and each top corner portion 1196 is configured to at least partially form a top stacking platform of the container. A container (not shown) may be formed from blank 1100 in the same fashion as container 400 is formed from blank 100, but including a top wall with locking mechanism 1180 formed in a similar fashion as bottom wall 442 of container 400.

Figure 12:
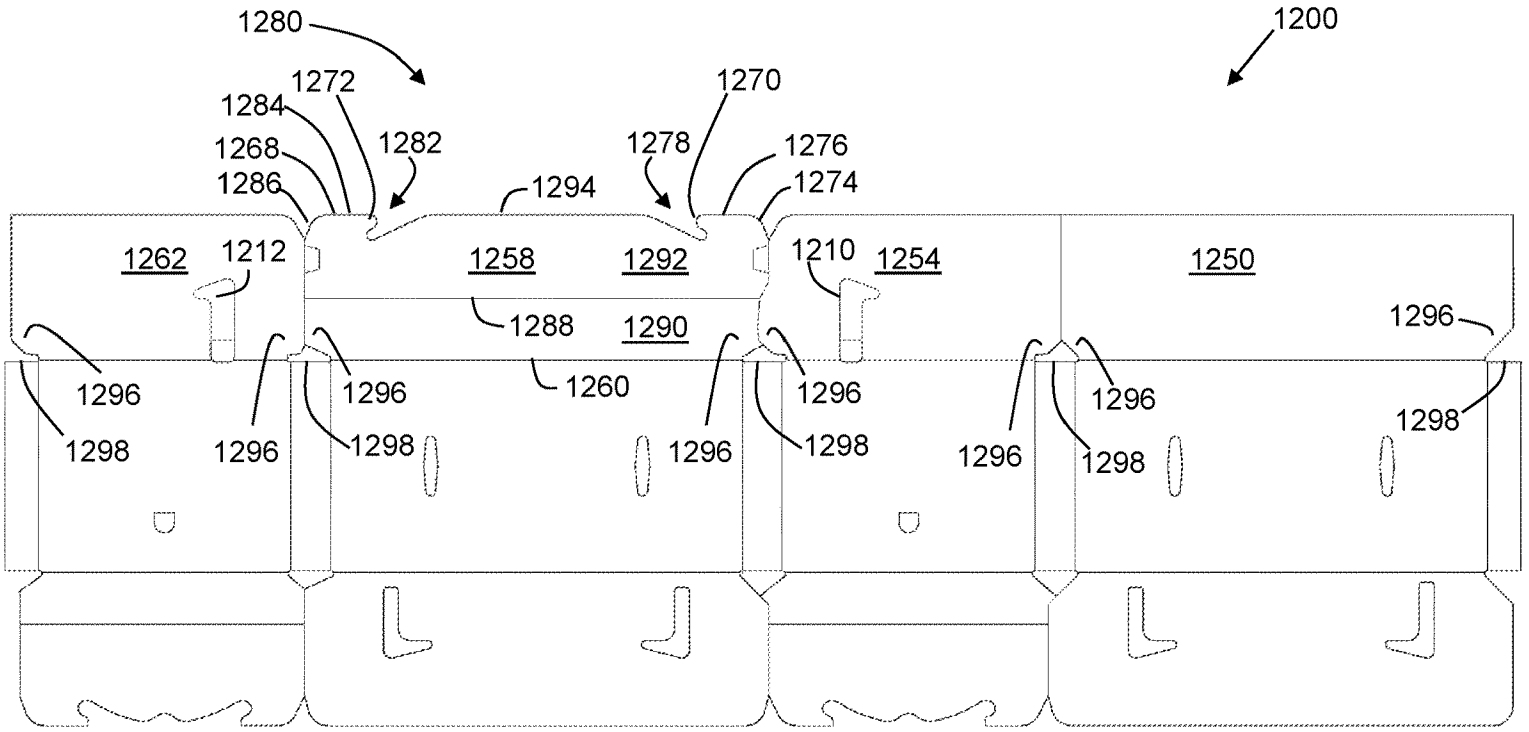
FIG. 12 is a top plan view of a fifth example embodiment of a blank of sheet material.

FIG. 12 is a top plan view of a fifth embodiment of a blank that may be used to form a fifth embodiment of a container. Specifically, FIG. 12 is a top plan view of an example embodiment of a blank 1200 of sheet material. With reference to FIGS. 1-5 and 12, blank 1200 is substantially identical to blank 100 except for the plurality of top panels 1250, 1254, 1258, and 1262, and as such the other elements of blank 1200 need not be relabeled. More specifically, plurality of top panels 1250, 1254, 1258, and 1262 include another example embodiment of a top locking mechanism, designated top locking mechanism 1280.

In the example embodiment, first top end panel 1254 includes a first locking slot 1210 that forms a portion of top locking mechanism 1280, and second top end panel 1262 includes a second locking slot 1212 that forms a portion of top locking mechanism 1280. Each locking slot 1210 and 1212 is generally L-shaped, and second locking slot 1212 is a mirror-image of first locking slot 1210.

Further in the example embodiment, second top side panel 1258 includes a free edge 1268 that defines a first locking tab 1270 and a second locking tab 1272. Locking tabs 1270 and 1272 form a portion of top locking mechanism 1280. More specifically, locking tab 1270 is configured to be received by locking slot 1210 and locking tab 1272 is configured to be received by locking slot 1212 when the container is erected. Free edge 1268 includes a first angled portion 1274, a first horizontal portion 1276, a first notch 1278, a middle horizontal portion 1294, a second notch 1282, a second horizontal portion 1284, and a second angled portion 1286. First locking tab 1270 is defined by first angled portion 1274, first horizontal portion 1276, and first notch 1278, and second locking tab 1272 is defined by second notch 1282, second horizontal portion 1284, and second angled portion 1286. Alternatively, locking tabs 1270 and/or 1272 and/or free edge 1268 have any suitable configuration that enables blank 1200 to function as described herein. Further, in an alternative embodiment, middle horizontal portion 1294 includes a middle indent (not shown).

In the example embodiment, second top side panel 1258 further includes a line of weakness 1288 extending across second top side panel 1258 substantially parallel to fold line 1260. Line of weakness 1288 divides second top side panel 1258 into a first portion 1290 extending from fold line 1260 and a second portion 1292 extending from line of weakness 1288 to free edge 1268. Line of weakness 1288 is configured to facilitate insertion of locking tabs 1270 and 1272 into locking slots 1210 and 1212, respectively, to erect the container. In an alternative embodiment, second top side panel 1258 does not include line of weakness 1288.

Thus, in the example embodiment of FIG. 12, top locking mechanism 1280 includes locking slots 1210 and 1212 and locking tabs 1270 and 1272. Also, similar to blank 100, at least one of the plurality of top panels 1250, 1254, 1258, and 1262 includes at least one top corner portion 1296 that extends adjacent to and above a free top edge 1298 of a respective corner panel and/or glue panel, and each top corner portion 1296 is configured to at least partially form a top stacking platform of the container. A container (not shown) may be formed from blank 1200 in the same fashion as container 400 is formed from blank 100, but including a top wall with locking mechanism 1280 formed in a similar fashion as bottom wall 442 of container 400.

Figure 13:
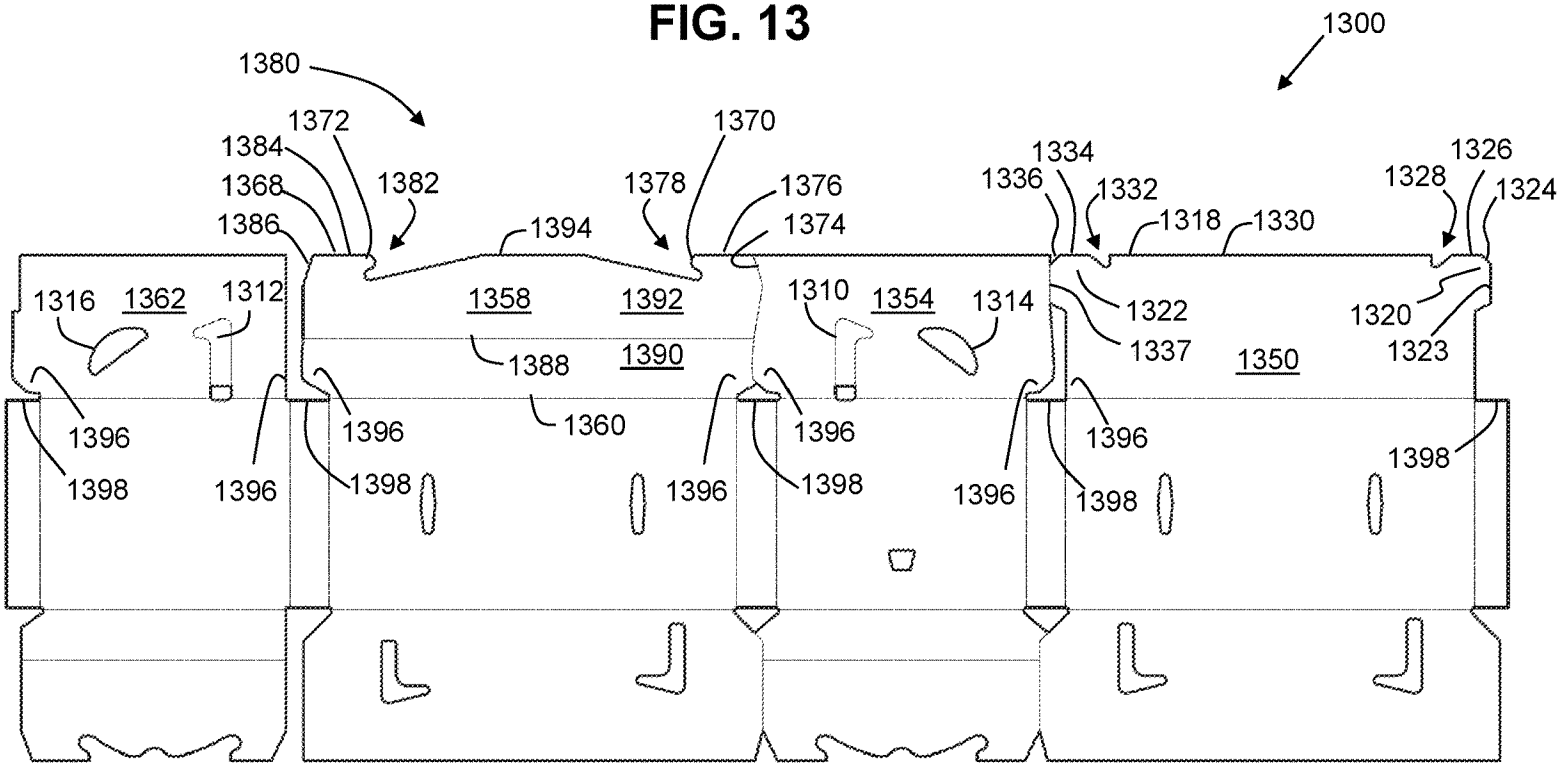
FIG. 13 is a top plan view of a sixth example embodiment of a blank of sheet material.

FIG. 13 is a top plan view of a sixth embodiment of a blank that may be used to form a sixth embodiment of a container. Specifically, FIG. 13 is a top plan view of an example embodiment of a blank 1300 of sheet material. With reference to FIGS. 1-5 and 13, blank 1300 is substantially identical to blank 100 except for the plurality of top panels 1350, 1354, 1358, and 1362, and as such the other elements of blank 1300 need not be relabeled. More specifically, plurality of top panels 1350, 1354, 1358, and 1362 include another example embodiment of a top locking mechanism, designated top locking mechanism 1380.

In the example embodiment, first top end panel 1354 includes a first locking slot 1310 that forms a portion of top locking mechanism 1380, and second top end panel 1362 includes a second locking slot 1312 that forms a portion of top locking mechanism 1380. Each locking slot 1310 and 1312 is generally L-shaped, and second locking slot 1312 is a mirror-image of first locking slot 1310.

Further in the example embodiment, second top side panel 1358 includes a free edge 1368 that defines a first locking tab 1370 and a second locking tab 1372. Locking tabs 1370 and 1372 form a portion of top locking mechanism 1380. More specifically, locking tab 1370 is configured to be received by locking slot 1310 and locking tab 1372 is configured to be received by locking slot 1312 when the container is erected. Free edge 1368 includes a first angled portion 1374, a first horizontal portion 1376, a first notch 1378, a middle horizontal portion 1394, a second notch 1382, a second horizontal portion 1384, and a second angled portion 1386. First locking tab 1370 is defined by first angled portion 1374, first horizontal portion 1376, and first notch 1378, and second locking tab 1372 is defined by second notch 1382, second horizontal portion 1384, and second angled portion 1386. Alternatively, locking tabs 1370 and/or 1372 and/or free edge 1368 have any suitable configuration that enables blank 1300 to function as described herein. Further, in an alternative embodiment, middle horizontal portion 1394 includes a middle indent (not shown).

In the example embodiment, second top side panel 1358 further includes a line of weakness 1388 extending across second top side panel 1358 substantially parallel to fold line 1360. Line of weakness 1388 divides second top side panel 1358 into a first portion 1390 extending from fold line 1360 and a second portion 1392 extending from line of weakness 1388 to free edge 1368. Line of weakness 1388 is configured to facilitate insertion of locking tabs 1370 and 1372 into locking slots 1310 and 1312, respectively, to erect the container. In an alternative embodiment, second top side panel 1358 does not include line of weakness 1388.

Further in the example embodiment, first top end panel 1354 includes a first stabilizing slot 1314 that forms a portion of top locking mechanism 1380, and second top end panel 1362 includes a second stabilizing slot 1316 that forms a portion of top locking mechanism 1380. Each stabilizing slot 1314 and 1316 is generally semi-ovoid-shaped, and second stabilizing slot 1316 is a mirror-image of first stabilizing slot 1314.

Further in the example embodiment, first top side panel 1350 includes a free edge 1318 that defines a first stabilizing tab 1320 and a second stabilizing tab 1322. Stabilizing tabs 1320 and 1322 form a portion of top locking mechanism 1380. More specifically, stabilizing tab 1320 is configured to be received by stabilizing slot 1316 and stabilizing tab 1322 is configured to be received by stabilizing slot 1314 when the container (not shown) is erected. Free edge 1318 includes a first vertical portion 1323, a first angled portion 1324, a first horizontal portion 1326, a first notch 1328, a middle horizontal portion 1330, a second notch 1332, a second horizontal portion 1334, a second angled portion 1336, and a second vertical portion 1337. First stabilizing tab 1320 is defined by first vertical portion 1323, first angled portion 1324, first horizontal portion 1326, and first notch 1328, and second stabilizing tab 1322 is defined by second notch 1332, second horizontal portion 1334, second angled portion 1336, and second vertical portion 1337. Alternatively, stabilizing tabs 1320 and/or 1322 and/or fire edge 1318 have any suitable configuration that enables blank 1300 to function as described herein. Further, in an alternative embodiment, middle horizontal portion 1330 includes a middle indent (not shown). In alternative embodiments, first top side panel 1350 further includes a line of weakness (not shown) similar to line of weakness 1388.

Thus, in the example embodiment of FIG. 13, top locking mechanism 1380 includes locking slots 1310 and 1312 and locking tabs 1370 and 1372, as well as stabilizing slots 1314 and 1316 and stabilizing tabs 1320 and 1322. Also, similar to blank 100, at least one of the plurality of top panels 1350, 1354, 1358, and 1362 includes at least one top corner portion 1396 that extends adjacent to a free top edge 1398 of a respective corner panel and/or glue panel, and each top corner portion 1396 is configured to at least partially form a top stacking platform of the container. A container (not shown) may be formed from blank 1300 in the same fashion as container 400 is formed from blank 100, but including a top wall with locking mechanism 1380 formed in a similar fashion as bottom wall 442 of container 400.

It should be understood that in alternative embodiments, any blank contemplated herein includes any suitable components and/or configuration of a top locking mechanism, such as any of top locking mechanism 1180, 1280, and 1380, that enables a container as contemplated herein to be suitably formed. It also should be understood that in alternative embodiments, any blank contemplated herein includes any suitable components and/or configuration of a top locking mechanism, such as any of top locking mechanism 1180, 1280, and 1380, that enables a container as contemplated herein to be suitably formed.

The above-described embodiments provide containers with top and bottom stacking platforms for shipping and/or storing products in a stacked configuration. Because the containers include top and bottom stacking platforms, a tendency of a bottom wall of an upper container to settle into, or "nest" within, a cavity defined by the sidewalls of the lower container is reduced or eliminated. The above-described embodiments also provide eight-sided containers constructed from blanks that include a plurality of side panels coupled together in series by preformed, generally parallel fold lines. Because at least one of the parallel fold lines is formed with an increased stiffness as compared to the others of the plurality of fold lines, a tendency for unintended rotation of the blank about the at least one fold line is reduced or eliminated. Thus, the blanks facilitate a formation of an eight-sided container in a knocked-down-flat configuration using a folder-gluer machine configured for four-sided containers, reducing or eliminating a need to modify or reconfigure the machine. Moreover, the above-described embodiments provide an optional insert for a reinforcing structure that increases a stacking strength of some such containers.

Exemplary embodiments of blanks and methods for forming containers are described above in detail. The apparatus and methods are not limited to the specific embodiments described herein, but rather, components of apparatus and/or steps of the methods may be utilized independently and separately from other components and/or steps described herein. For example, the methods may also be used in combination with other containers and methods, and are not limited to practice with only the containers and methods as described herein. Rather, the example embodiments can be implemented and utilized in connection with many other container applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to illustrate the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A blank of sheet material for forming a container, the blank comprising:

a plurality of side panels and a glue panel coupled together in series along generally parallel fold lines, the plurality of side panels includes a plurality of corner panels; and a plurality of bottom panels, each bottom panel extends from a bottom edge of a corresponding one of the plurality of side panels, at least a first bottom panel includes a first bottom corner portion, and at least a second bottom panel includes a second bottom corner portion, wherein the first and second bottom corner portions overlap and extend adjacent to and beneath a free bottom edge of a corresponding one of the corner panels where the container is erected;

wherein the first bottom corner portion and the second bottom corner portion are configured to extend beyond a boundary defined by a plurality of sidewalls of the container to at least partially form a bottom stacking platform when the container is erected, wherein at least a portion of the first bottom corner portion extending beyond said boundary overlaps at least a portion of the second bottom corner portion extending beyond said boundary.

2. The blank of claim 1, further comprising, a plurality of top panels, each top panel extends from a top edge of a corresponding one of the plurality of side panels, at least a first top panel includes at least a first top corner portion, and at least a second top panel includes at least a second top corner portion, wherein the first and second top corner portions overlap and extend adjacent to and beneath a free top edge of a corresponding one of the corner panels where the container is erected.

3. The blank of claim 2, wherein each at least one top corner portion is configured to extend beyond a boundary defined by a plurality of sidewalls of the container to at least partially form a top stacking platform when the container is erected.

4. The blank of claim 1, wherein at least two of the plurality of top panels are coupled together across a line of weakness.

5. The blank of claim 4, wherein the line of weakness is defined by at least one tab integrally formed across a segmented cut line.

6. A container formed from a blank of sheet material, wherein the blank includes a plurality of side panels and a glue panel coupled together in series along generally parallel fold lines, the container comprising:

a plurality of side walls that includes a plurality of corner walls, the plurality of side walls cooperate to define a boundary of the container;

a bottom wall that comprises a plurality of bottom panels, the bottom wall includes at least one bottom corner platform portion, each at least one bottom corner platform portion is disposed proximate a bottom edge of a respective one of the corner walls, each at least one bottom corner platform portion extends outside the boundary to at least partially form a bottom stacking platform and each at least one bottom corner platform portion comprises extensions of two of the bottom panels, wherein an overlapping portion of said extensions extends outside the boundary.

7. The container of claim 6, further comprising a top wall comprising a plurality of top panels, the top wall includes at least one top corner platform portion, each at least one top corner platform portion is disposed proximate a top edge of a respective one of the corner walls, each at least one top corner platform portion extends outside the boundary, and each at least one top corner platform portion comprises extensions of two of the top panels.

8. The container of claim 7, wherein the at least one top corner platform portion includes four top corner platform portions, each of the four top corner platform portions is disposed proximate a top edge of a respective one of the plurality of corner walls.

9. The container of claim 7, wherein at least two of the plurality of top panels are coupled together across a line of weakness.

10. The container of claim 9, wherein the line of weakness is defined by at least one tab integrally formed across a segmented cut line.

11. The container of claim 6, wherein the at least one bottom corner platform portion includes four bottom corner platform portions, each of the four bottom corner platform portions is disposed proximate a bottom edge of a respective one of the plurality of corner walls.

* * * * *